US009613567B2

(12) United States Patent
Okuno et al.

(10) Patent No.: US 9,613,567 B2
(45) Date of Patent: Apr. 4, 2017

(54) DISPLAY DEVICE WITH INITIALIZATION CONTROL AND METHOD OF DRIVING PIXEL CIRCUIT THEREOF

(71) Applicant: SAMSUNG DISPLAY CO., LTD., Yongin, Gyeonggi-do (KR)

(72) Inventors: Takeshi Okuno, Yokohama (JP); Masayuki Kumeta, Yokohama (JP); Eiji Kanda, Yokohama (JP); Ryo Ishii, Yokohama (JP); Naoaki Komiya, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 269 days.

(21) Appl. No.: 14/103,019

(22) Filed: Dec. 11, 2013

(65) Prior Publication Data

US 2014/0160185 A1 Jun. 12, 2014

(30) Foreign Application Priority Data

Dec. 11, 2012 (JP) ..... 2012-270827

(51) Int. Cl.

| | |
|---|---|
| ***G09G 3/30*** | (2006.01) |
| ***G09G 3/3233*** | (2016.01) |
| ***G09G 3/3266*** | (2016.01) |
| ***G09G 3/3283*** | (2016.01) |

(52) U.S. Cl.

CPC ..... *G09G 3/3233* (2013.01); *G09G 3/3266* (2013.01); *G09G 3/3283* (2013.01); *G09G 2300/0842* (2013.01); *G09G 2300/0861* (2013.01); *G09G 2310/0251* (2013.01); *G09G 2310/0262* (2013.01); *G09G 2310/08* (2013.01)

(58) Field of Classification Search

CPC ..... G09G 3/3233
USPC ..... 345/76, 78
See application file for complete search history.

(56) References Cited

U.S. PATENT DOCUMENTS

| | | | | |
|---|---|---|---|---|
| 8,624,880 | B2 * | 1/2014 | Ishiguro | G09G 3/3233 345/204 |
| 2008/0225027 | A1 * | 9/2008 | Toyomura | G09G 3/3233 345/204 |
| 2010/0026612 | A1 * | 2/2010 | Yamamoto | G09G 3/3233 345/76 |
| 2013/0194248 | A1 * | 8/2013 | Kim | G09G 3/3233 345/212 |

FOREIGN PATENT DOCUMENTS

| | | |
|---|---|---|
| JP | 2008-249743 | 10/2008 |
| JP | 2009-008874 | 1/2009 |
| JP | 2009-258227 | 11/2009 |
| JP | 2009-265328 | 11/2009 |

* cited by examiner

*Primary Examiner* — Kwang-Su Yang
(74) *Attorney, Agent, or Firm* — Lee & Morse, P.C.

(57) ABSTRACT

A display device includes a pixel circuit having a driving transistor for driving a light-emitting element based on a gradation voltage held by a holding capacitor. The display device performs a first writing of gradation data using a first initialization voltage and a second writing of the gradation data using a second initialization voltage.

18 Claims, 30 Drawing Sheets

DISPLAY DEVICE WITH INITIALIZATION CONTROL AND METHOD OF DRIVING PIXEL CIRCUIT THEREOF

CROSS-REFERENCE TO RELATED APPLICATION

Japanese Patent Application No. 2012-270827, filed on Dec. 11, 2012, and entitled "Display Device and Method Of Driving Pixel Circuit Thereof," is incorporated by reference herein in its entirety.

BACKGROUND

1. Field

One or more embodiments described herein relate to driving pixel circuits.

2. Description of the Related Art

A display device includes pixel circuits disposed in a lattice shape. Each pixel circuit may include a driving transistor for driving a light-emitting element. In operation, the driving transistor may generate a current which flows into a light-emitting element based on gradation data. Based on this current, the element emits light of a corresponding gray scale value.

In such a device, the actual luminance of the light-emitting element may be different from the luminance corresponding to the gradation data. This may occur, for example, when the threshold voltages of the driving transistors of the pixel circuits are different from one another. The difference in luminance degrades the quality of the image to be displayed. This degradation tends to increase with increasing resolution.

For example, in recent years, the number of pixels of a display device has increased to provide for display of higher definition images. The time taken to write gradation data at a pixel has lessened in order to achieve the desired resolution. Attempts at reducing this time have proven ineffective.

SUMMARY

In accordance with one embodiment, a display device includes at least one pixel circuit and a control circuit for operating the at least one pixel circuit. The at least one pixel circuit includes a light-emitting element, a holding capacitor to hold a gradation voltage corresponding to gradation data, a driving transistor to provide the light-emitting element with a driving current according to the gradation voltage, a first switch transistor connected between an initialization voltage line for transferring an initialization voltage and a gate of the driving transistor, the first switch transistor to be turned on or off according to a first scan line signal, and a second switch transistor connected between the gate and a drain of the driving transistor, the second switch transistor to be turned on or off according to a second scan line signal.

The control circuit outputs the first scan line signal, the second scan line signal, and the initialization voltage. During a first period, the control circuit turns on the first switch transistor and turns off the second switch transistor to set charges of the holding capacitor to an initial state using a first initialization voltage having a first voltage level as the initialization voltage;

During a second period, the control circuit turns off the first switch transistor and turns on the second switch transistor to charge the holding capacitor based on a first gradation voltage corresponding to first gradation data using the first initialization voltage as the initialization voltage.

During a third period, the control circuit turns off the first switch transistor and the second switch transistor to switch the initialization voltage from the first initialization voltage to a second initialization voltage having a second voltage level different from the first voltage level.

During a fourth period, the control circuit turns off the first switch transistor and turns on the second switch transistor to charge the holding capacitor based on a second gradation voltage based on the second initialization voltage, the second gradation voltage corresponding to second gradation data.

During a fifth period, the control circuit drives the light-emitting element according to the second gradation voltage when the driving transistor is turned on. The driving transistor, the first switch transistor, and the second switch transistor may be P-type transistors.

The pixel circuit may include an emission transistor connected between the drain of the driving transistor and the light-emitting element, wherein the control circuit turns off the emission transistor during the first to fourth periods.

The pixel circuit may include an emission transistor connected between the drain of the driving transistor and the light-emitting element, wherein the control circuit turns on the emission transistor during the fifth period.

The display device may include a power line control circuit configured to provide a power supply voltage to a source of the driving transistor during the first period and the third period and to provide the gradation data to the source of the driving transistor during the second period and the fourth period.

The display device may include a plurality of pixel circuits arranged in a lattice, a first power supply line connected to pixel circuits disposed at an odd-numbered row; and a second power supply line connected to pixel circuits disposed at an even-numbered row, wherein the power line control circuit provides the gradation data to the second power supply line during a period where the power supply voltage is applied to the first power supply line and provides the power supply voltage to the second power supply line during a period where the gradation data is applied to the first power supply line.

The display device may include a power line control circuit configured to provide gradation data to a source of the driving transistor during the first to fourth periods and a power supply voltage to the source of the driving transistor during the fifth period.

The display device may include a voltage control circuit configured to provide a high level of voltage to a cathode of the light-emitting element during the first to fourth periods and a low level of voltage to the cathode of the light-emitting element during the fifth period. The first initialization voltage may be higher than the second initialization voltage.

In accordance with another embodiment, a method is provided for driving a pixel circuit which includes a light-emitting element, a holding capacitor configured to hold a gradation voltage corresponding to a gradation data, a driving transistor configured to provide the light-emitting element with a driving current according to the gradation voltage, a first switch transistor connected between an initialization voltage line for transferring an initialization voltage and a gate of the driving transistor and configured to be turned on or off according to a first scan line signal, and a second switch transistor connected between the gate and a drain of the driving transistor and configured to be turned on or off according to a second scan line signal.

The method includes, during a first period, turning on the first switch transistor and turning off the second switch transistor to set charges of the holding capacitor to an initial state using a first initialization voltage having a first voltage level as the initialization voltage; during a second period, turning off the first switch transistor and turning on the second switch transistor to charge the holding capacitor based on a first gradation voltage corresponding to first pixel data using the first initialization voltage as the initialization voltage; during a third period, turning off the first switch transistor and the second switch transistor to switch the initialization voltage from the first initialization voltage to a second initialization voltage having a second voltage level different from the first voltage level; during a fourth period, turning off the first switch transistor and turning on the second switch transistor to charge the holding capacitor based on a second gradation voltage corresponding to second pixel data using the second initialization voltage as the initialization voltage; and during a fifth period, driving the light-emitting element according to the second gradation voltage when the driving transistor is turned on. The driving transistor, the first switch transistor, and the second switch transistor may be P-type transistors.

The pixel circuit may include an emission transistor connected between the drain of the driving transistor and the light-emitting element, and wherein the method further includes turning off the emission transistor during the first to fourth periods.

The pixel circuit may include an emission transistor connected between the drain of the driving transistor and the light-emitting element, and wherein the method further includes turning on the emission transistor during the fifth period.

The method may include providing a power supply voltage to a source of the driving transistor during the first period and the third period, and providing the gradation data to the source of the driving transistor during the second period and the fourth period.

The pixel circuit may be disposed in plurality to have a lattice shape, wherein a first power supply line is connected to pixel circuits disposed at an odd-numbered row and a second power supply line is connected to pixel circuits disposed at an even-numbered row, and wherein the gradation data is provided to the second power supply line during a period where the power supply voltage is applied to the first power supply line and the power supply voltage is provided to the second power supply line during a period where the gradation data is applied to the first power supply line.

The gradation data may be provided to a source of the driving transistor during the first to fourth periods and a power supply voltage is provided to the source of the driving transistor during the fifth period.

A high level of ground voltage may be provided to a cathode of the light-emitting element during the first to fourth periods and a low level of ground voltage is provided to the cathode of the light-emitting element during the fifth period. The first initialization voltage may be higher than the second initialization voltage.

In accordance with another embodiment, a method of driving pixel circuits in a display device includes (a) setting an initialization current for a first pixel circuit to be substantially equal to an initialization current for a second pixel circuit; (b) shifting a gate voltage for the first pixel circuit by a first amount; and (c) shifting a gate voltage for the second pixel circuit by a second amount substantially equal to the first amount, wherein the initialization currents for the first and second pixel circuits correspond to different first and second initialization voltages, and wherein drain currents of driving transistors of first and second pixel circuits are substantially equal based on the shifted gate voltages of the first and second pixel circuits. Also, at least (a) and (b) are performed during a data update period for the first pixel circuit, wherein the date update period includes a period to compensate for a threshold voltage of the driving transistor of the first pixel circuit.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
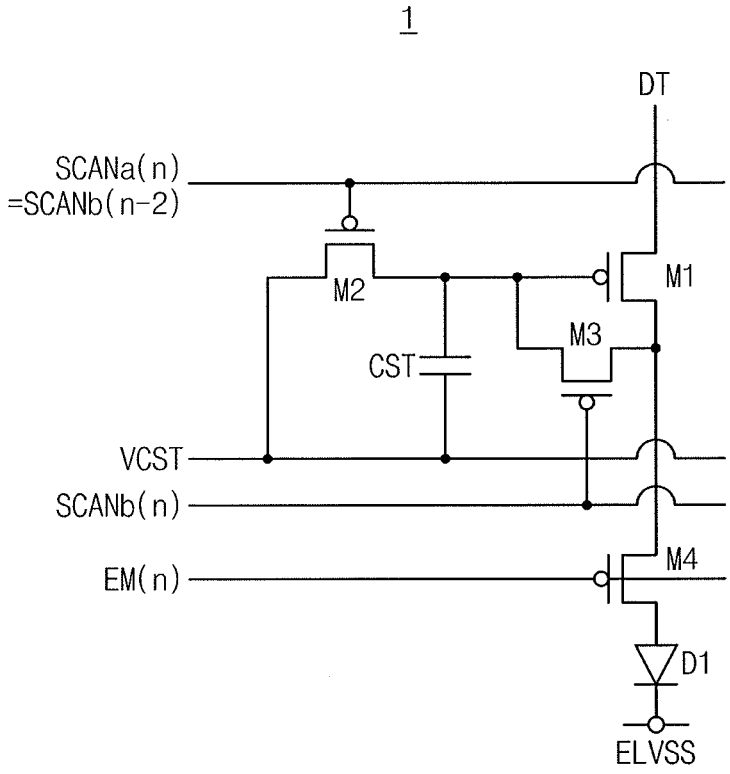
FIG. 1 illustrates a first embodiment of a pixel circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

The embodiments will be described with reference to accompanying drawings. Prior to a description on the embodiments, a problem caused by variation in the threshold voltage of a driving transistor will be described.

Overview

Figure 19:
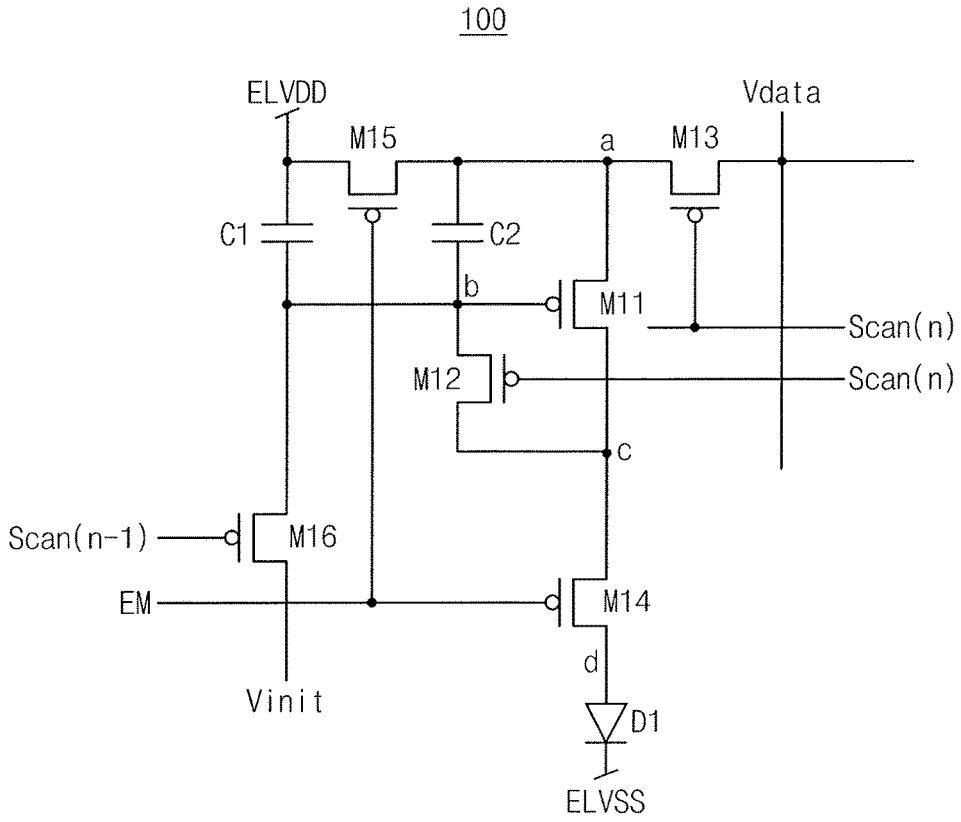
Fig. 19 (RELATED ART)
FIG. 19 illustrates another type of pixel circuit.

FIG. 19 illustrates a circuit diagram of a pixel circuit 100 including a driving transistor M11, switch transistors M12, M13, and M16, emission transistors M14 and M15, capacitors C1 and C2, and a light-emitting element D1 which, for example, may be an organic EL element.

A first end of capacitor C1 is connected to a power supply voltage ELVDD and a second end is connected to a source of the switch transistor M16. A second scan line signal (e.g., a scan line signal of a pixel circuit in a preceding row) is applied to a gate of switch transistor M16. An initialization voltage Vint is coupled to the drain of switch transistor M16.

The emission transistor M15 has a first terminal connected to the first end of capacitor C1 and a second terminal connected to a first end of capacitor C2. An emission control signal EM is applied to a gate of emission transistor M15. A second end of capacitor C2 is connected to a gate of driving transistor M11. A gate of driving transistor M11 is connected to second ends of capacitors C1 and C2, a source may be connected to the first end of capacitor C2, and a drain may be connected to an anode of a light-emitting element through the emission transistor M14. The emission transistor M14 is connected between the drain of the driving transistor M11 and the anode of the light-emitting element. The emission control signal EM is applied to the gate of transistors M14 and M15.

The switch transistor M12 is connected between a gate and a drain of driving transistor M11, and has a gate connected to receive a first scan line signal (e.g., a scan line signal corresponding to a current pixel circuit). A first terminal of switch transistor M13 is connected to a source of driving transistor M11, a second terminal is connected to a data line for transferring a gradation data VDATA, and a gate is connected to receive the first scan line signal. The light-emitting element may have a cathode connected to a ground power for supplying a ground voltage ELVSS.

Figure 20:
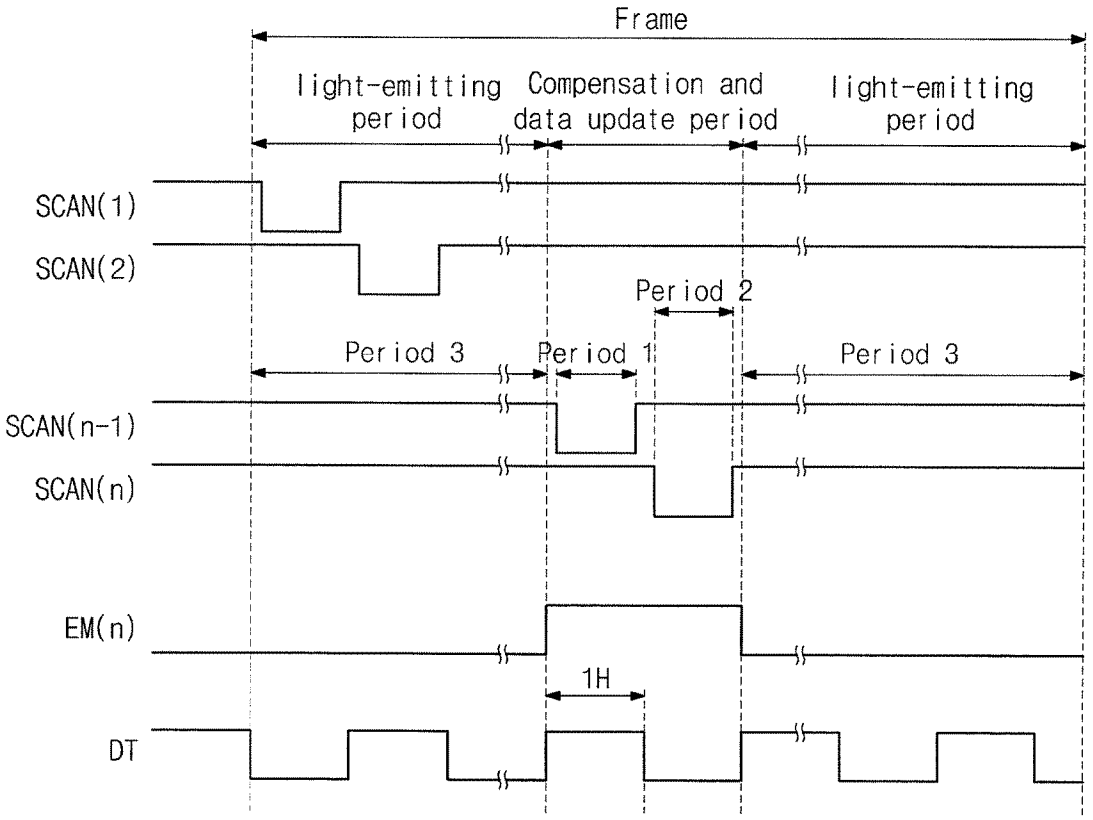
Fig. 20 (RELATED ART)
FIG. 20 illustrates a driving order of pixel circuits relating to FIG. 19.

FIG. 20 is a timing diagram describing the operation of pixel circuit 100. As illustrated in FIG. 20, operation of pixel circuit 100 may be divided into a data update period and a light-emitting period. During a period where a frame of image is displayed by a display device, the data update period and the light-emitting period may be sequentially performed every row from a first row of pixel circuits to an nth row of pixel circuits.

During the data update period, the pixel circuit 100 may perform compensation for variation in the threshold voltage of driving transistor M11 at the same time. As illustrated in FIG. 20, the data update period may be divided into two periods, namely period 1 and period 2. During period 1, switch transistor M16 may be turned when second scan line signal SCAN(n−1) has a low level. At this time, a gate potential of the driving transistor M11 may be reset to an initialization voltage Vint.

During period 2, a first scan line signal Scan(n) is at a low level and switch transistors M12 and M13 are turned on. At this time, image data Vdata is applied to the gate of driving transistor M11 through the switch transistor M13 and the switch transistor M12. The connection of driving transistor M11 and switch transistor M12 allows the gate and drain of driving transistor M11 to be diode connected. Thus, capacitor C1 may hold the written voltage and the gate voltage Vgate of driving transistor M11 may be expressed by equation (1), in which Vth indicates a threshold voltage of the driving transistor M11.

$$V\text{gate}=V\text{data}-V\text{th} \tag{1}$$

A third period of operation is included in the light-emitting period. In period 3, the switch transistors M12 and M13 are turned off, emission transistors M14 and M15 are turned on by emission control signal EM having a low level. Since a voltage across capacitor C1 is equal to a gate-source voltage Vgs of the driving transistor M11, a current biased by gradation voltage held in capacitor C1 may be supplied to the light-emitting element (e.g., an organic EL element) from power supply voltage ELVDD through the driving transistor M11 and emission transistor M14. A current flowing to driving transistor M11 in a saturation state may be expressed by equation (2).

$$I=\beta(V\text{gs}-V\text{th})^2 \tag{2}$$

In equation (2), β indicates a coefficient determined by the size of transistor M11, Vgs indicates a gate-source voltage, and Vth indicates a threshold voltage of driving transistor M11.

Because Vgs is equal to ELVDD−(Vdata−Vth), a current finally supplied to the organic EL element may be expressed by equation (3).

$$I=\beta(ELVDD-V\text{data}+V\text{th}-V\text{th})^2 \tag{3}$$

Referring to equation (3), a threshold voltage Vth may be cancelled out, and the amount of current flowing to the organic EL element may be controlled only by the gradation voltage corresponding input gradation data VDATA, without dependency on a variation in the threshold voltage of the driving transistor M11. Thus, it is possible to compensate for variation in the threshold voltage of driving transistor M11 of the pixel circuit 100 in order to improve uniformity of display device images.

However, the compensation performed by pixel circuit 100 may vary in performance based on a difference in the gradation data. More specifically, in the event that an initialization operation of pixel circuit 100 is not performed, a voltage corresponding to a previous frame of image data may remain at a gate of the driving transistor M11. In the event that black data (e.g., 4.5V) of a previous frame remains, it is impossible to write white data (e.g., 3.5V) at a current frame. This may be obvious from a relationship between a gate voltage of the driving transistor M11 and a source voltage (i.e., gradation voltage), even though threshold voltage Vth is compensated.

Figure 21:
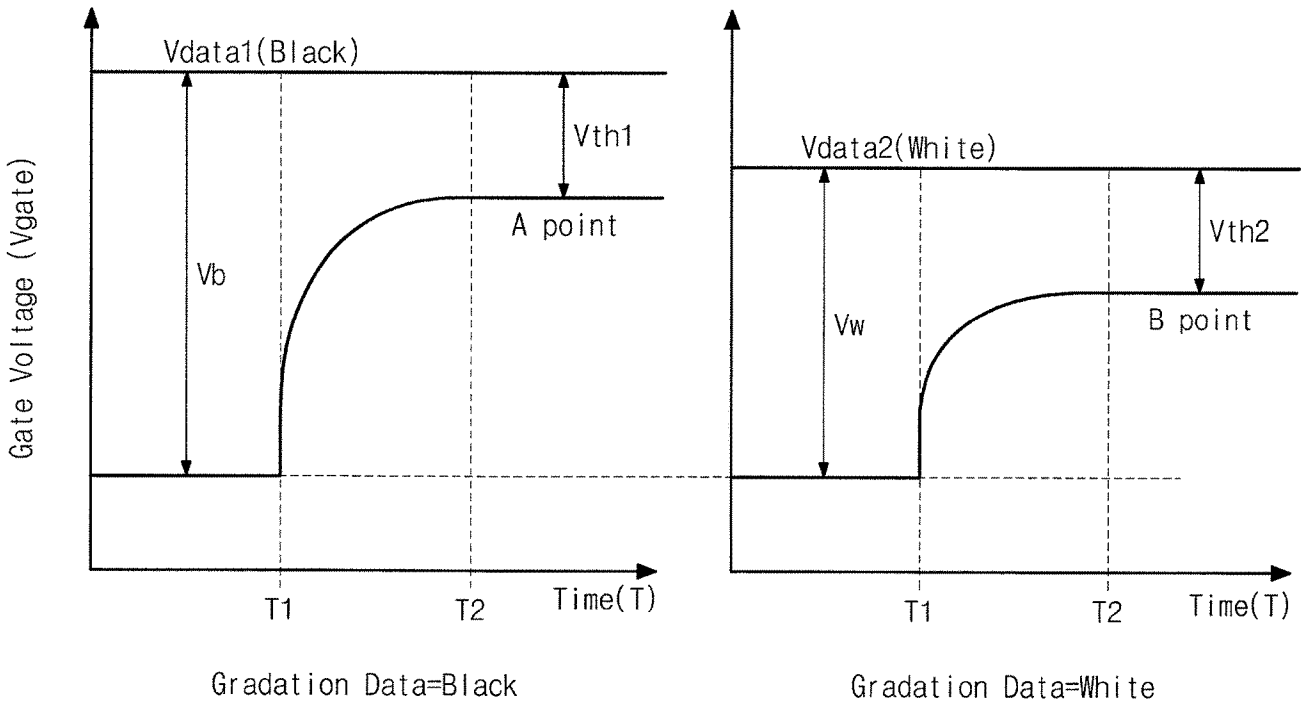
Fig. 21 (RELATED ART)
FIG. 21 illustrates an initialization voltage of the pixel circuit in FIG. 19.

FIG. 21 are graphs showing one technique which has been proposed for varying an initialization voltage Vint according to input gradation data. The graphs show a gate voltage at an initialization state and a gate voltage of a driving transistor M11 in a compensation period. As illustrated in FIG. 21, the gate and drain of driving transistor M11 may be diode-connected by turning on a transistor M12 after a gate voltage Vgate of driving transistor M11 of a pixel circuit 100 is set to an initialization voltage Vint, and a compensation operation may commence (timing T1).

A gate voltage (e.g., a voltage difference Vth1 between a gradation voltage and gradation data Vdata1 corresponding to point A and a voltage difference Vth2 between a gradation voltage and gradation data Vdata2 corresponding to point B at a point of time (timing T2)) when the driving transistor M11 is close to a cut-off state may be almost equal to the threshold voltage of the driving transistor M11.

However, as illustrated in FIG. 21, in the event that a voltage difference between an initialization voltage Vint and a black data voltage Vdata1 is not equal to a voltage difference between the initialization voltage Vint and a white data voltage Vdata2, a bias voltage applied to the driving transistor M11 may be varied during a threshold voltage compensation operation T1 to T2. Therefore, a difference between compensation voltages (here, Vth1 and Vth2) may be generated. This may mean that performance is varied upon compensating for the threshold voltage of the driving transistor M11 based on gradation data VDATA. In an attempt to solve this problem, an initialization voltage Vint may be predetermined such that a voltage difference Vb between the initialization voltage Vint and gradation data Vdata1 is equal to a voltage difference Vw between the initialization voltage Vint and gradation data Vdata2.

However, a basic pixel circuit may necessitate six or more transistors and five or more control lines for controlling the transistors. Also, to vary the initialization voltage Vint, for example, a capacitor C2 as shown in FIG. 19 may be added or an external circuit may be separately required to generate initialization voltage Vint corresponding to data voltage Vdata. Taking either of these approaches may be disadvantageous for yield or for achieving high definition of a panel.

Also, in recent years, the allowable compensation time (e.g., corresponding to a period between T1 and T2) of a high-definition display device has been shortened, for example, in order to achieve higher resolutions. In the event that compensation time is sufficient, the driving transistor M11 may continue to be close to a cut-off state. For this reason, it is possible to secure a gate voltage at a state where a gate voltage of the driving transistor M11 is saturated. Also, it is possible to fully compensate for effects caused by variation in the threshold voltage of the driving transistor M11.

However, in an actual driving operation of a display device, compensation time may be first decided by the driving frequency and number of pixels of the display device. It may therefore be impossible to secure a sufficient compensation time for certain driving frequencies and pixel resolutions. If the compensation time to be secured is shortened by the high-definition resolution of the display device, the gate voltage of driving transistor M11 may be decided before a compensation operation is completed. Thus, performance of compensating for variation in threshold voltage may be lowered.

Also, when a difference between gradation data voltage Vdata and initialization voltage Vint is relatively large, influence of a variation in mobility of driving transistor M11 may not be ignored at compensation.

Figure 22:
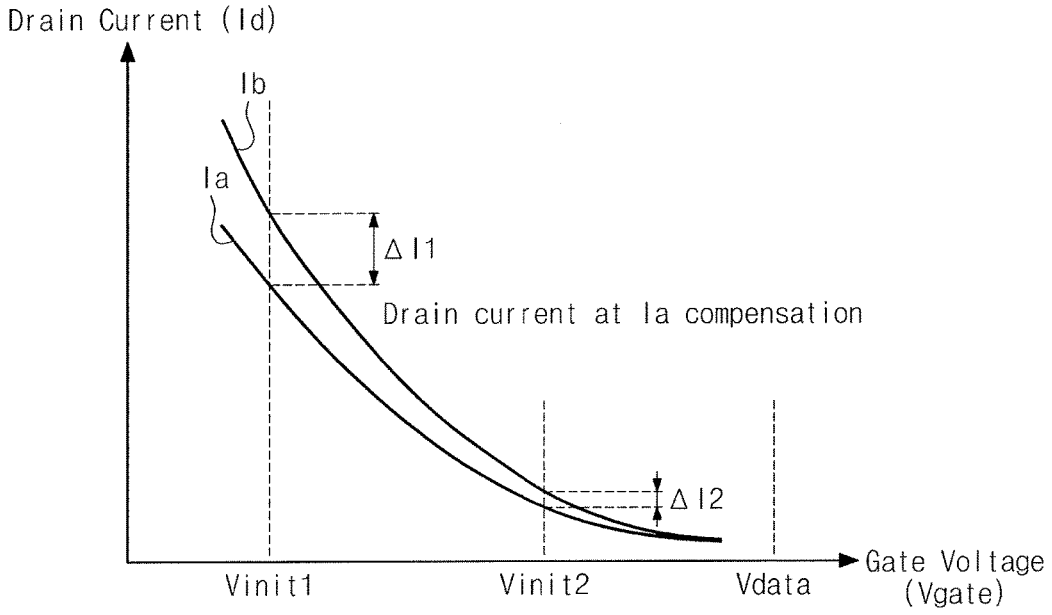
Fig. 22 (RELATED ART)
FIG. 22 illustrates driving transistor characteristics of the pixel circuit in FIG. 19.

FIG. 22 is a graph illustrating a relationship between an initialization voltage Vint and drain current of driving transistor M11. In FIG. 22, the driving transistor M11 is assumed to have characteristics Ia and Ib of drain currents according to a mobility difference. When the initialization voltage is set to Vinit1, performance may be affected by a mobility variation corresponding to ΔI1. When the initialization voltage is set to Vinit2, influence on mobility variation may be reduced to ΔI2. In other words, to suppress influence of mobility variation every pixel in a threshold voltage compensation operation, the initialization voltage Vint may be set to a voltage proximate to a data voltage Vdata, in a range where a compensation operation is not affected.

First Embodiment

FIG. 1 illustrates a first embodiment of a pixel circuit 1 that may include a driving transistor M1, a first switch transistor M2, a second switch transistor M3, an emission transistor M4, a light-emitting element (e.g., an organic EL element D1), and a holding capacitor CST. The holding capacitor CST may hold a gradation voltage corresponding to gradation data. The holding capacitor CST may be connected between a gate of the driving transistor M1 and an initialization voltage line for transferring an initialization voltage VCST.

The driving transistor M1 may provide the organic EL element D1 with a driving current according to the gradation voltage. The driving transistor M1 may have a source connected to a power supply line to which gradation data DT and a power supply voltage ELVDD are alternately supplied. The driving transistor may also include a drain connected to an anode of the organic EL element D1 through the emission transistor M4. A gate of the driving transistor M1 may be connected to one end of the holding capacitor CST and to the initialization voltage line through the first switch transistor M2.

The first switch transistor M2 may be connected between the initialization voltage line carrying the initialization voltage VCST and the gate of the driving transistor M1. The first switch transistor M2 may be turned on or off according to a first scan line signal. Also, in pixel circuit 1, a first scan line signal SCANa(n) may be a first scan line signal SCANb(n−2) for controlling a data update operation of pixel circuits disposed in a predetermined number (e.g., 2) of prior rows a current pixel circuit. The pixel circuits may be arranged in a lattice shape.

The second switch transistor M3 may be connected between the gate and the drain of the driving transistor M1. The second switch transistor M3 may be turned on or off by a second scan line signal SCANb(n). The emission transistor M4 is connected between a drain of the driving transistor M11 and the organic EL element D1. The emission transistor M4 may be turned on or off by an emission control signal EM.

A first embodiment of a display device may include a control circuit which generates a first scan line signal SCANa, a second scan line signal SCANb, and the emission control signal EM. Also, the control circuit may output the initialization voltage VCST. The control circuit may switch a set voltage VSET and a bias voltage VBAS to output a switched voltage as the initialization voltage VCST.

Figure 2:
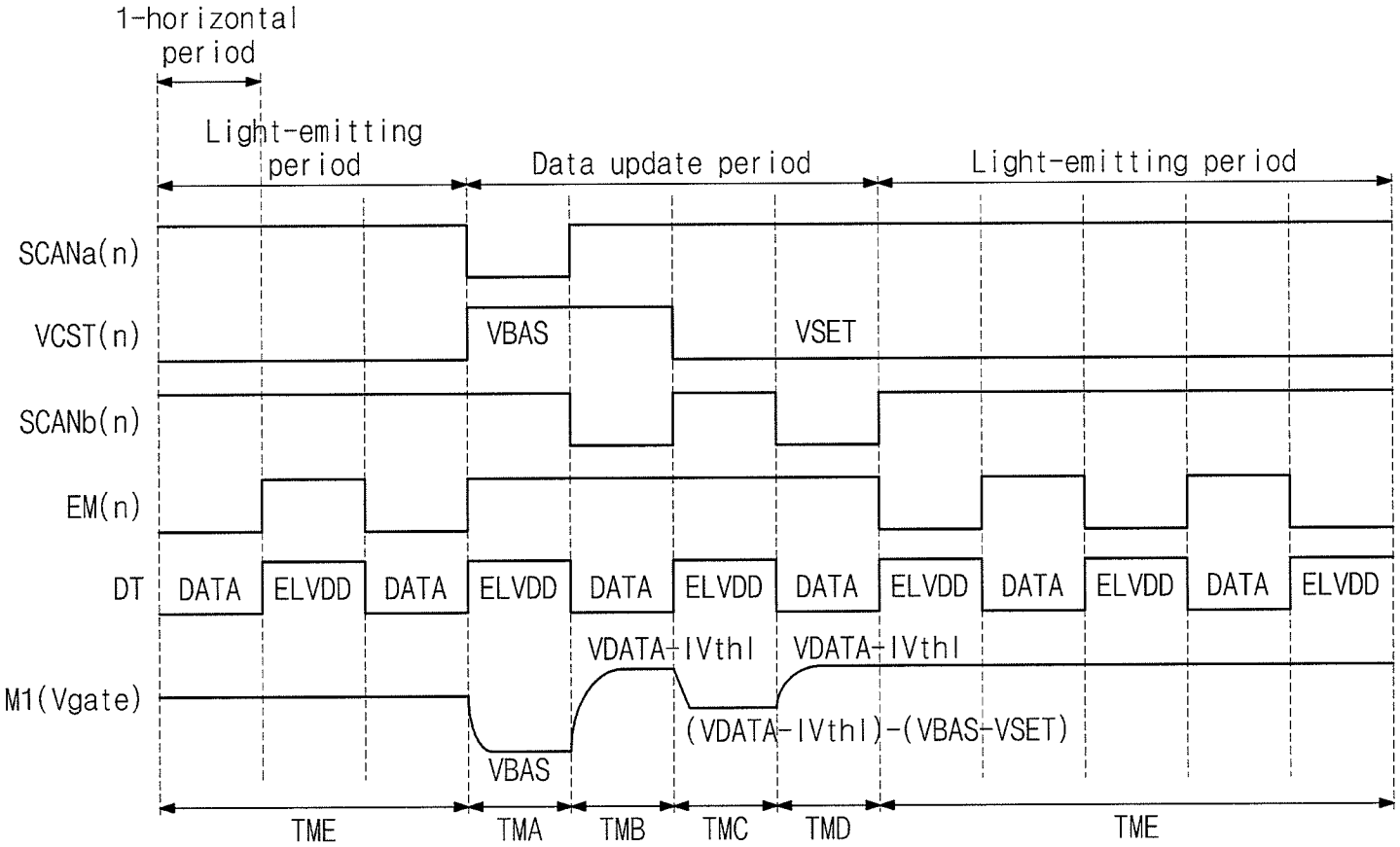
FIG. 2 illustrates a timing diagram for a driving order of pixel circuits according to the first embodiment.

FIG. 2 is a timing diagram illustrating a driving order of pixel circuit 1 in accordance with the first embodiment. As illustrated in FIG. 2, a control signal may be switched every horizontal period when a row of pixel circuits is driven, and each pixel circuit may be controlled during a data update period and a light-emitting period.

The data update period may include a predetermined number of periods. In accordance with one embodiment, the data update period includes a first period TMA to a fourth period TMD.

The first period TMA may be a bias voltage writing period where a bias voltage VBAS is written to holding capacitor CST. During the first period TMA, the control circuit may perform a control operation as follows. A first switch transistor M2 may be turned on by a first scan line signal SCANa(n) having a low level, and a second switch transistor M3 may be turned off by a second scan line signal SCANb (n) having a high level. Initialization voltage VCST (which may be referred to as a first initialization voltage, e.g., a bias voltage VBAS) having a first voltage level is applied. As a result, a voltage across the holding capacitor CST may be the bias voltage VBAS at the first period TMA. Charges of the holding capacitor CST may therefore be set to an initialization state. Also, a gate voltage of the driving transistor M1 may be set to the bias voltage VBAS.

Figure 3A:
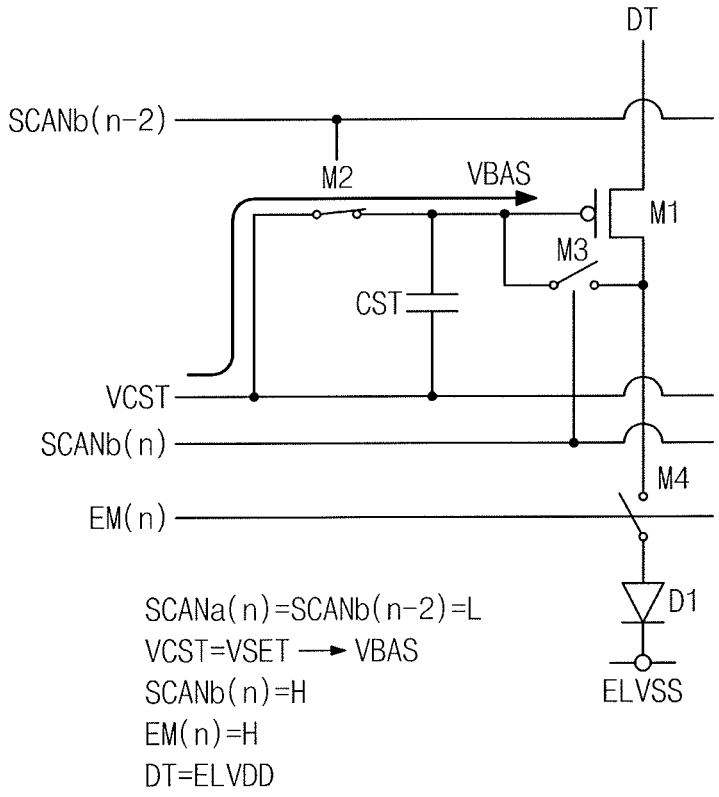
FIG. 3A illustrates shows operation of the pixel circuit in a first period.

FIG. 3A illustrates operation of pixel circuit 1 in the first period TMA. As illustrated in FIG. 3A, during the first period TMA, the bias voltage VBAS may be applied to a gate of the driving transistor M1 and power supply voltage ELVDD may be applied to a source of the driving transistor M1. However, since the driving transistor M1 and an emission transistor M4 are in a turn-off state, no current may flow into an organic EL element D1.

A second period TMB may be a pre-data writing period where gradation data VDATA is written prior to a compensation operation based on the size of gradation data. More specifically, in the second period TMB, the control circuit may perform a control operation as follows. The first switch transistor M2 may be turned off by the first scan line signal having a high level, and the second switch transistor M3 may be turned on by the second scan line signal having a low level. As a result, during the second period TMB, the holding capacitor CST may be charged by the gradation voltage corresponding to first gradation data. (An initialization voltage VCST may be referred to as a bias voltage VBAS.)

Figure 3B:
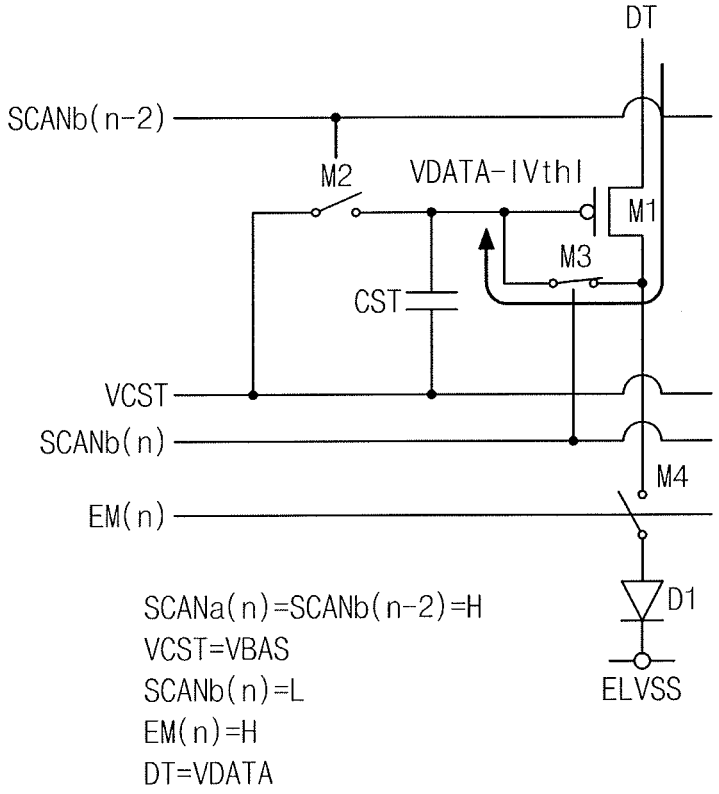
FIG. 3B illustrates operation of the pixel circuit in a second period.

FIG. 3B illustrates operation of pixel circuit 1 in the second period TMB. As illustrated n FIG. 3B, during the second period TMB, gradation data VDATA is provided to the source of driving transistor M1. Therefore, a gradation voltage corresponding to the gradation data VDATA may be applied to the gate of driving transistor M1 along a path passing through driving transistor M1 and second switch transistor M3. At this time, a gate voltage Vgate of the driving transistor M1 may be expressed by equation (4).

$$V\text{gate}=V\text{DATA}-V\text{th} \quad (4)$$

In equation (4), Vth is the threshold voltage of driving transistor M1. In the event that organic EL element D1 emits a light based on the gate voltage Vgate of the driving transistor M1 at the second period TMB, a luminance variation caused by a variation in a threshold voltage of the driving transistor M1 may be reduced like a pixel circuit 100 shown in FIG. 19.

A third period TMC may be an initialization voltage set-up period where an initialization voltage is set up to perform a compensation operation based on the size of the gradation data. In the third period TMC, the control circuit may perform a control operation as follows. The first switch transistor M2 may be turned off by the first scan line signal having a high level, and the second switch transistor M3 may be turned off by the second scan line signal having a high level. The initialization voltage VCST may be switched from the bias voltage VBAS to a second initialization voltage (e.g., a set voltage VSET) having a second voltage level different from the first voltage level. In exemplary embodiments, set voltage VSET may be lower than the bias voltage VBAS.

Figure 3C:
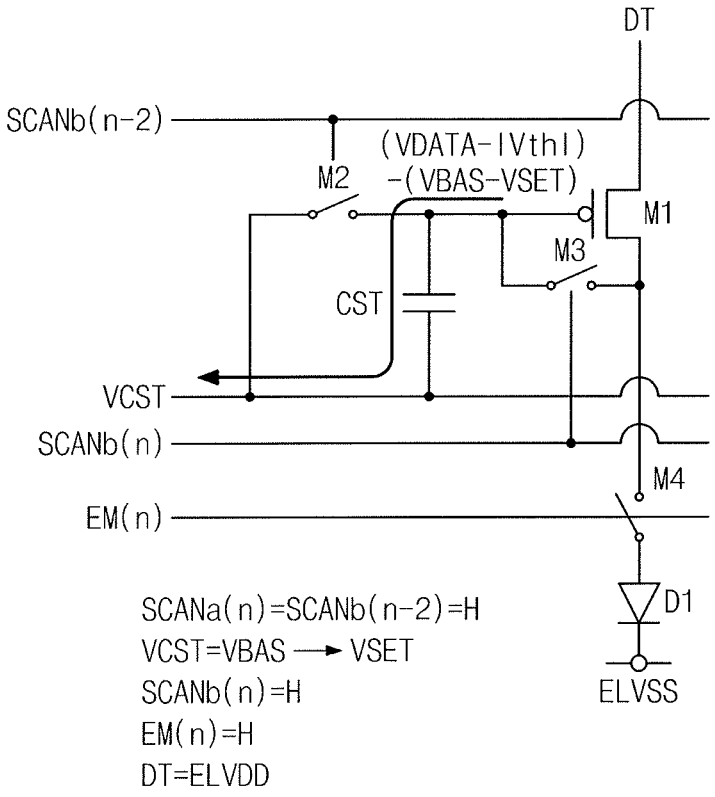
FIG. 3C illustrates operation of the pixel circuit in a third period.

FIG. 3C illustrates operation of pixel circuit 1 in the third period TMC. As illustrated in FIG. 3C, during the third period TMC, a gate voltage of the driving transistor M1 as set in the second period TMB may be lowered. The gate voltage Vgate of the driving transistor M1 in the third period TMC may be expressed by equation (5).

$$V\text{gate}=(V\text{DATA}-V\text{th})-(V\text{BAS}-V\text{SET}) \quad (5)$$

The gate voltage Vgate of the driving transistor M1 expressed by equation (5) may be an initialization voltage based on a gradation voltage that is actually used for a light-emitting operation.

A fourth period TMD may be a data writing period where a gradation voltage corresponding to gradation data to be used in the light-emitting operation is written. In the fourth period TMD, the control circuit may perform a control operation as follows. The first switch transistor M2 may be turned off by the first scan line signal having a high level, and the second switch transistor M3 may be turned on by the second scan line signal having a low level. Also, the initialization voltage VCST may be referred to as the set voltage VSET. During the fourth period TMD, the holding capacitor CST may be charged by a second gradation voltage corresponding to second gradation data.

Figure 3D:
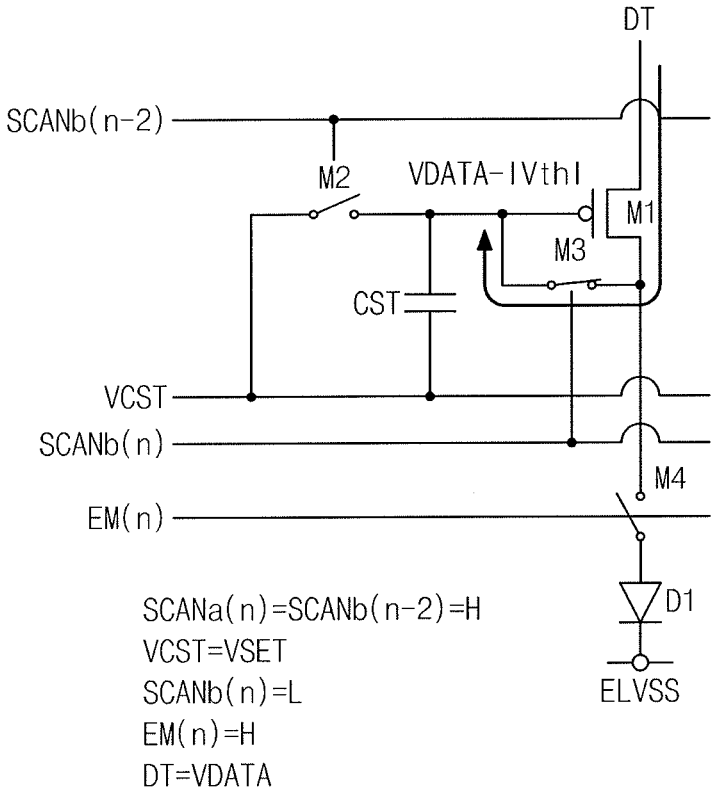
FIG. 3D illustrates operation of the pixel circuit in a fourth period.

FIG. 3D illustrates operation of pixel circuit 1 in the fourth period TMD. As illustrated n FIG. 3D, during the fourth period TMD, gradation data VDATA may be provided to a source of the driving transistor M1. Therefore, during the fourth period TMD, a gradation voltage corresponding to gradation data VDATA may be applied to a gate of the driving transistor M1 through the driving transistor M1 and the second switch transistor M3. A gate voltage Vgate of the driving transistor M1 at the fourth period TMD may be expressed by equation (6).

$$V\text{gate}=V\text{DATA}-V\text{th} \quad (6)$$

Although the gate voltage Vgate of the driving transistor M1 expressed by the equation (6) is equal to a gate voltage Vgate of the driving transistor M1 expressed by the equation (4), as illustrated in FIG. 2, a voltage difference between a gate voltage Vgate of the third period TMC and a gate voltage Vgate of the fourth period TMD may correspond to a voltage difference between a bias voltage VBAS and a set voltage VSET, without complying with or giving consideration to the size of gradation data VDATA. For this reason, it is possible to maintain a variation in the gate voltage Vgate constantly during the fourth period TMD, without complying with or irrespective of the size of the gradation data VDATA.

Operation during the light-emitting period will now be described. Since the light-emitting period follows the data update period, the light-emitting period may be referred to as a fifth period TME. During the fifth period TMD, organic EL element D1 may be driven based on a second gradation voltage written at the fourth period TMD while the driving transistor M1 is turned on. More particularly, as illustrated in FIG. 2, since an emission control signal EM has a low level during a period where a power supply voltage ELVDD is applied to a source of the driving transistor M1, a current may be applied to the organic EL element D1 during the fifth period TME.

Figure 3E:
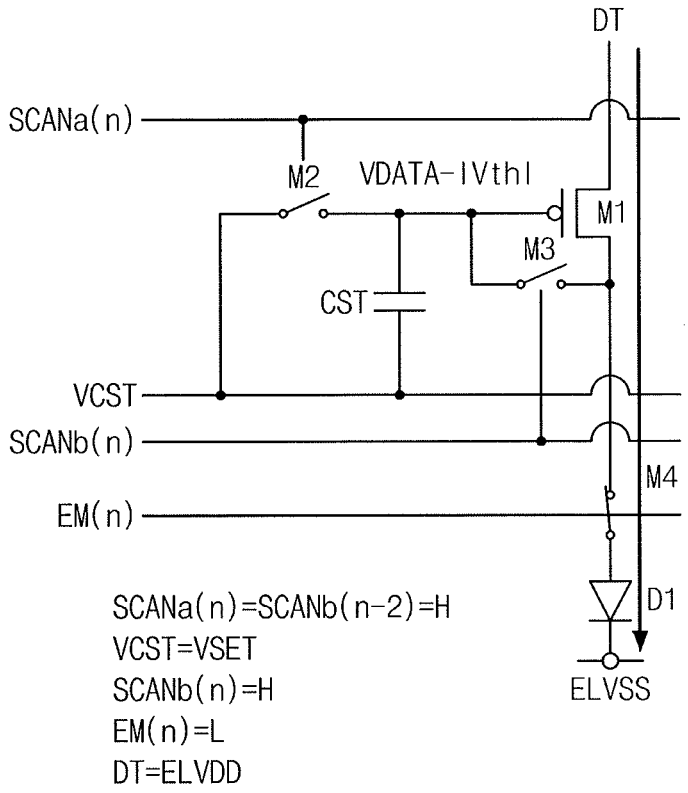
FIG. 3E illustrates operation of the pixel circuit in a fifth period.

FIG. 3E illustrates operation of pixel circuit 1 in the fifth period TME. As illustrated n FIG. 3E, during a light-emitting operation, the first switch transistor M2 and the second switch transistor M3 may be turned off, and the emission transistor M4 may be turned on. Thus, a current may be supplied to the organic EL element D 1. A current flowing into the organic EL element D1 may be expressed by equation (7).

$$I=\beta(Vgs-Vth)^2 \quad (7)$$

In equation (7), β indicates a coefficient associated with performance according to the size of driving transistor M1, and Vgs indicates a gate-source voltage of the driving transistor M1. Since the gate-source voltage Vgs is (ELVDD−(VDATA−Vth)) at the fifth period TME, a current I supplied to the organic EL element D1 may be expressed in equation (8) based on equations (6) and (7).

$$I=\beta(ELVDD-Vdata+Vth-Vth)^2 \quad (8)$$

In pixel circuit 1 according to the first embodiment, variation in the threshold voltage of driving transistor M1 may be compensated for, accuracy based on gradation data VDATA may be improved, and the amount of current flowing into the organic EL element D1 may be controlled.

Figure 4A:
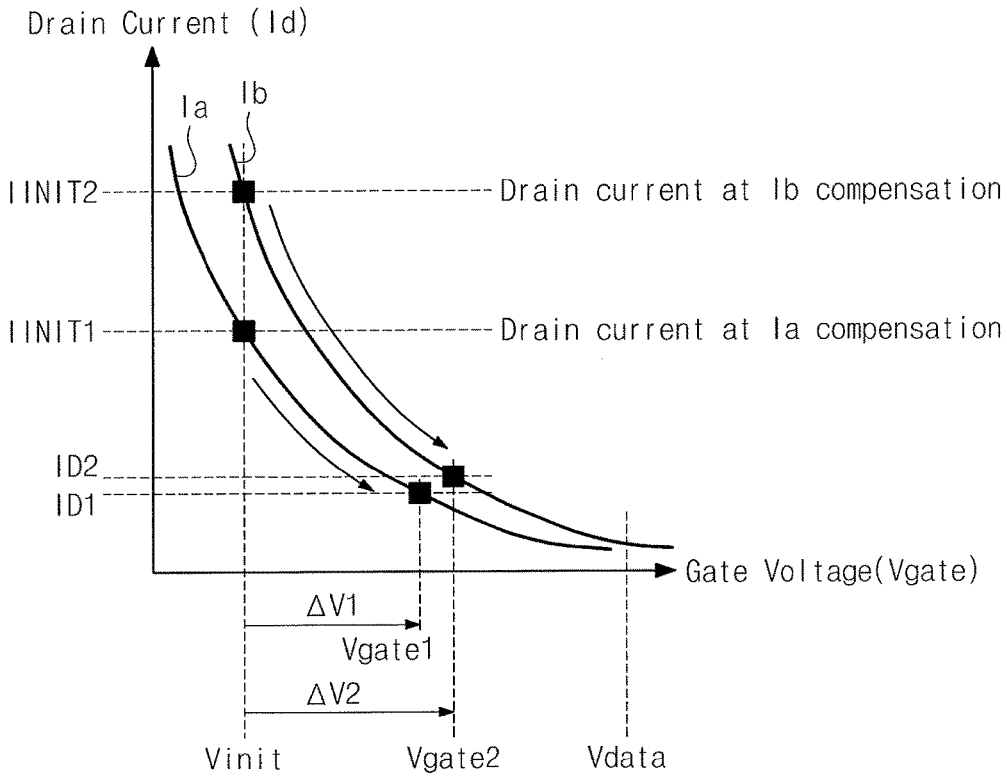
Fig. 4A (RELATED ART)
FIG. 4A illustrates variations in a gate voltage and drain current that may occur in one type of pixel circuit that has been proposed.
Figure 4B:
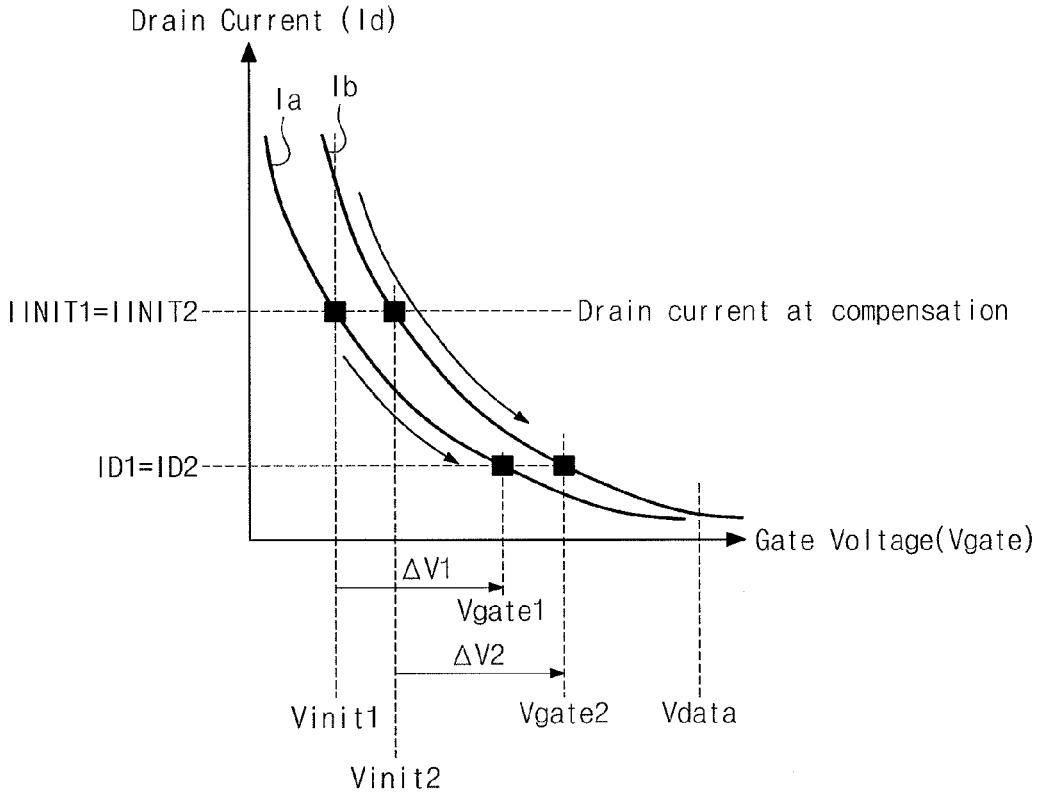
FIG. 4B illustrates variations in a gate voltage and drain current in the pixel circuit of the first embodiment.

FIGS. 4A and 4B illustrate different performance of pixel circuit 1 according to the first embodiment during the fourth period TMD and another pixel circuit 100. More specifically, FIG. 4A is a graph describing variations in a gate voltage and drain current resulting from a variation in the threshold voltage of a driving transistor in pixel circuit 100. FIG. 4B is a graph describing variations in the gate voltage and drain current resulting from a variation of a threshold voltage of the driving transistor in pixel circuit 1 according to the first embodiment.

In comparing these graphs, first, it is to be understood that Equation (5) includes gradation data VDATA and the threshold voltage Vth of the driving transistor M1 as factors for deciding an initialization voltage. This means that the initialization voltage varies for every pixel based on the input gradation data VDATA and the threshold voltage Vth of the driving transistor M1. For improved understanding, an effect will be described when the initialization voltage Vint is varied in connection with gradation data VDATA and the threshold voltage Vth of the driving transistor M1.

In FIG. 4A, corresponding to pixel circuit 100, a gate voltage Vgate of the driving transistor M11 may be reset to a constant initialization voltage Vint at threshold voltage compensation. Therefore, assuming that the threshold voltage characteristic of two different pixels corresponds to curves Ia and Ib, an initialized drain current value may start from different values IINIT1 and IINIT2. Through a threshold voltage compensation operation, the gate voltage Vgate of the driving transistor M1 may vary up to (VDATA−Vth). If a compensation time is insufficient, the gate voltage Vgate of the driving transistor M1 may not vary up to (VDATA−Vth). That is, drain currents ID1 and ID2 of the pixels may be different from each other due to a threshold voltage at an end of the threshold voltage compensation operation. This difference may cause an irregular display of images.

In contrast, in pixel circuit 1 according to the first embodiment shown in FIG. 4B, a threshold voltage of driving transistor M1 may be first compensated at a second period TMB, so that an initialization voltage Vint of the driving transistor M1 is decided in connection with a threshold voltage Vth of the driving transistor M1. Therefore, drain currents IINIT1 and IINIT2 may be the same at a start of the compensation operation. Thus, even in the case where compensation time is insufficient in the threshold voltage compensation operation, variation voltages ΔV1 and ΔV2 corresponding to the gate voltage of driving transistor M1 may correspond to a voltage shifted by the same potential. That is, drain currents ID1 and ID2 may become the same at an end of the threshold voltage compensation operation, and a difference between threshold voltages of the driving transistors of the pixels may be cancelled.

Thus, as understood from equation (5), since an initialization voltage is set in connection with gradation data VDATA, it is possible to adjust drain currents of pixels at a start of the threshold voltage compensation operation regardless of a variation of the gradation data VDATA.

Also, as understood from equation (5), an initialization voltage VCST may be adjusted to have any offset value by selecting a set voltage VSET and a bias voltage VBAS suitably. In accordance with one embodiment, it may be set to a voltage proximate to gradation data VDATA without being influenced by the performance of compensation. As a result, the influence of mobility may be suppressed at a threshold voltage compensation operation, for example, as shown in FIG. 22.

Figure 5:
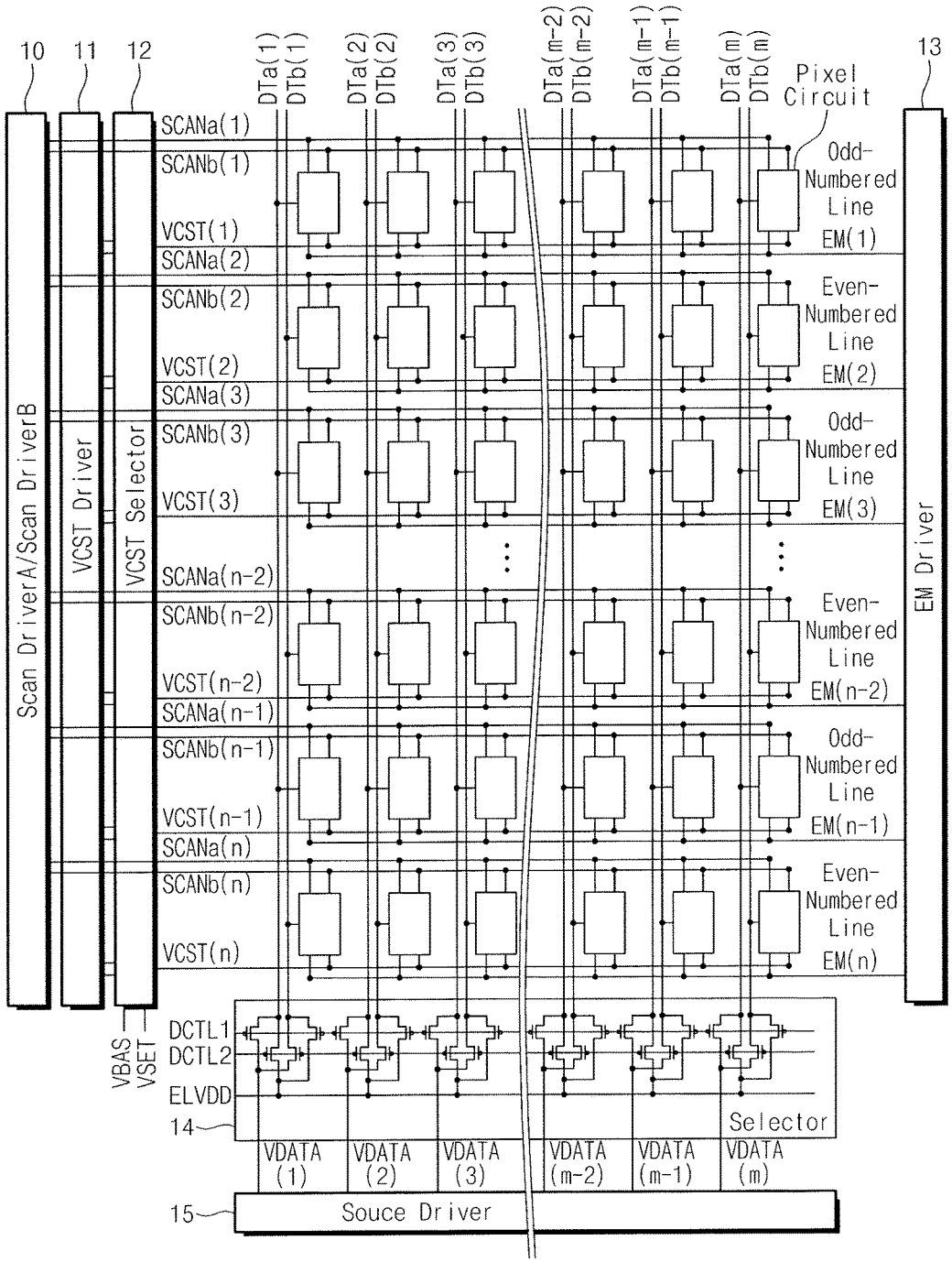
FIG. 5 illustrates a display device that includes a pixel circuit according to the first embodiment.

FIG. 5 illustrates a first embodiment of a display device which includes pixel circuit 1 and a control circuit. In FIG. 5, a scan driver circuit 10, an initialization voltage control circuit 11, an initialization voltage selecting circuit 12, and an emission control circuit 13 may constitute the control circuit. A gradation data control circuit 14 and a source driver circuit 15 may constitute a power line control circuit. Also, as illustrated in FIG. 5, pixel circuits 1 of the display device may be disposed in a lattice shape.

The scan driver circuit 10 may output a first scan line signal SCANa and a second scan line signal SCANb to pixel circuits sequentially from a first row based on a timing signal provided from a circuit.

Under a control of the initialization voltage control circuit 11, whether one of a bias voltage VBAS or a set voltage VSET is output as an initialization voltage VCST ma be decided every row based on a timing signal provided from a circuit.

The initialization voltage selecting circuit 12 may select one of the bias voltage VBAS or the set voltage VSET generated from a circuit according to an instruction from the initialization voltage control circuit 11. The initialization voltage selecting circuit 12 may output the selected voltage as the initialization voltage VCST every row.

The emission control circuit 13 may output an emission control signal EM based on a timing control signal provided from a circuit.

The gradation data control circuit 14 may select a power supply voltage ELVDD and a gradation data VDATA according to power control signals DCTL1 and DCTL2 from a circuit. The gradation data control circuit 14 may output the selected voltage to a power supply line. The source driver circuit 15 may generate the gradation data VDATA based on image data provided from a circuit.

As illustrated in FIG. 5, the display device may include a first power supply line DTa and a second power supply line DTb. The first power supply line DTa may be connected to pixel circuits disposed at odd-numbered rows, and the second power supply line DTb may be connected to pixel circuits disposed at even-numbered rows. During a period where power supply voltage ELVDD is supplied to the first power supply line DTa, the power line control circuit may provide the gradation data VDATA to the second power supply line DTb. During a period where the gradation data VDATA is supplied to the first power supply line DTa, the power line control circuit may provide the power supply voltage ELVDD to the second power supply line DTb. The power line control circuit may provide a source of a driving transistor M1 with the power supply voltage ELVDD at first, third and fifth periods TMA, TMC, and TME and with gradation data VDATA at second and fourth periods TMB and TBD.

Figure 6:
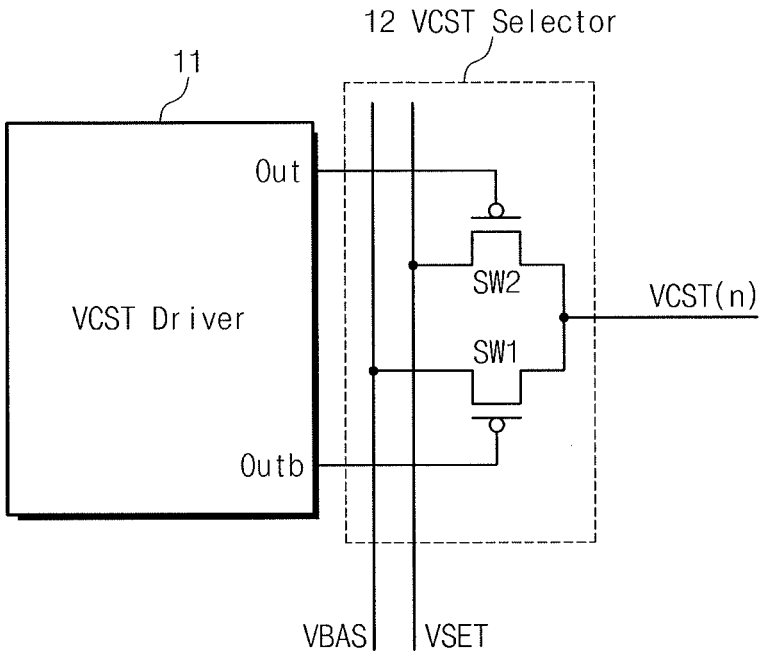
FIG. 6 illustrates an initialization voltage selecting circuit of a display device according to the first embodiment.

FIG. 6 illustrates an embodiment of the initialization voltage selecting circuit 12 and the initialization voltage control circuit 11, which outputs control signals out and outb to the initialization voltage selecting circuit 12. As illustrated in FIG. 6, the initialization voltage selecting circuit 12 may be configured to connect a line supplied with a bias voltage VBAS with an initialization voltage line through a switch transistor SW1. Also, the initialization voltage selecting circuit 12 may be configured to connect a line supplied with a set voltage VSET from an external source with the initialization voltage line through a switch transistor SW2.

The initialization voltage control circuit 11 may output control signals out and outb that are complementary. In response to control signals out and outb, the initialization voltage selecting circuit 12 may output one of the bias voltage VBAS and the set voltage VSET as an initialization voltage VCST. That is, in the display device according to the first embodiment, predetermined voltages may be supplied as the bias voltage VBAS and the set voltage VSET. Also, two different voltages may be selected by the initialization voltage control circuit 11 and the initialization voltage selecting circuit 12. Since the display device according to the first embodiment only generates constant voltages as the bias voltage VBAS and set voltage V SET, it need not control a voltage value dynamically. Thus, it is possible to make a circuit size small.

Figure 7:
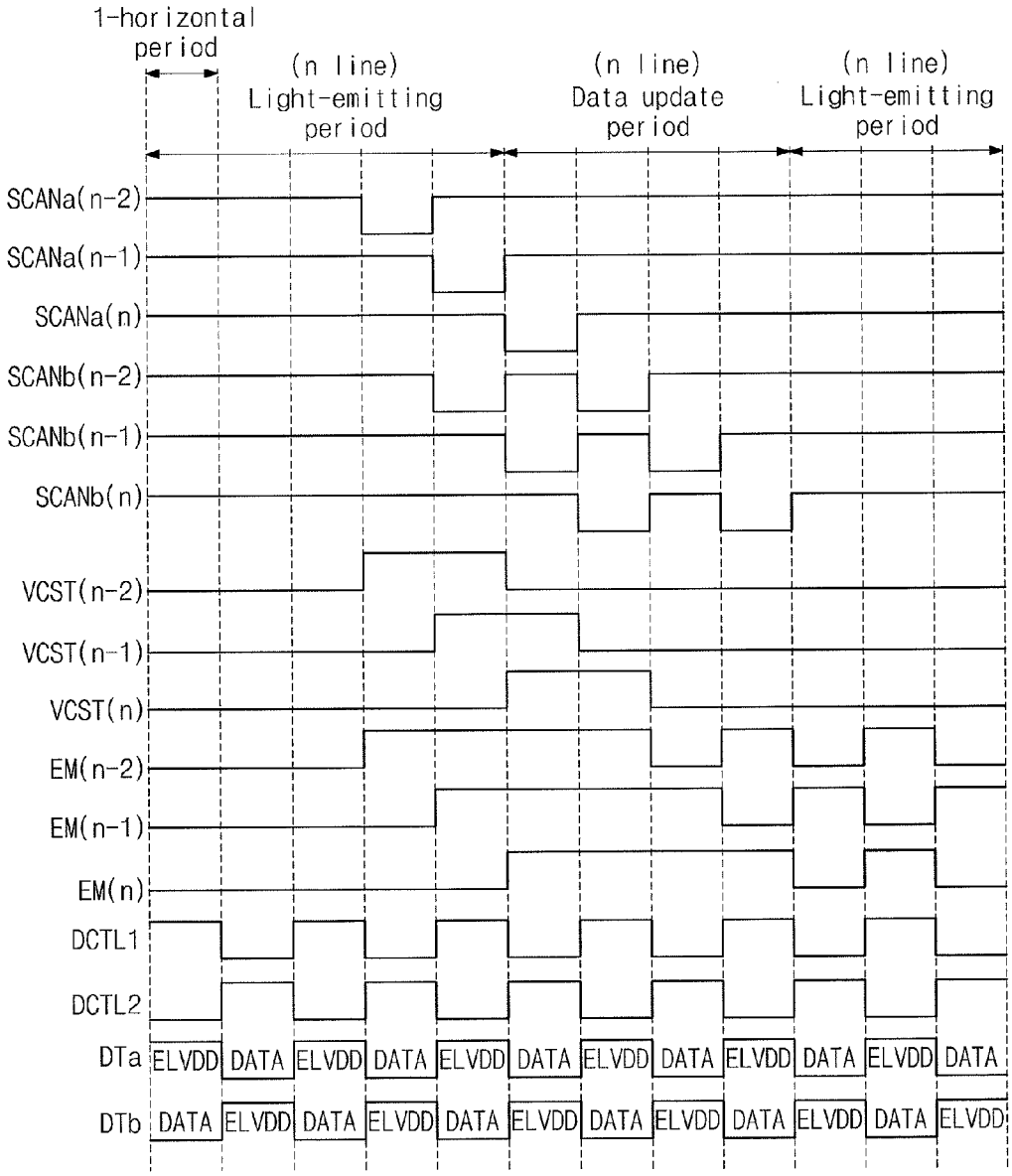
FIG. 7 illustrates a timing diagram for operating a display device according to the first embodiment.

FIG. 7 illustrates a timing diagram for operating the display device according to the first embodiment. As illustrated in FIG. 7, the display device according to the first embodiment may operate based on a data write period and a light-emitting period alternately. During the data write period, a threshold voltage compensation operation and a data writing operation may be performed by providing gradation data VDATA to a power supply line. During the light-emitting period, a light-emitting operation is performed by providing a power supply voltage ELVDD to the power supply line.

The display device according to the first embodiment may provide the gradation data VDATA to an even-numbered row during a period where a power supply voltage ELVDD is provided to an odd-numbered row. The display device may provide the power supply voltage ELVDD to the even-numbered row during a period where the gradation data VDATA is provided to the odd-numbered row. In the display device according to the first embodiment, if the threshold voltage compensation operation and the data writing operation are completed after initialization of each pixel, light-emitting and non-light-emitting states may be iteratively selected with respect to each of even-numbered and odd-numbered lines every horizontal scan period.

Figure 8:
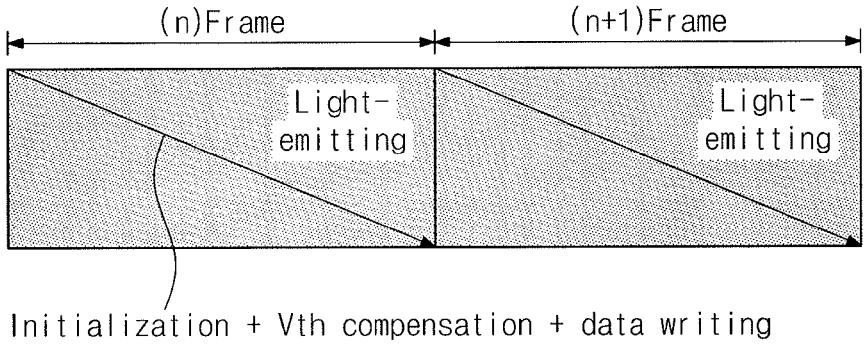
FIG. 8 illustrates a light-emitting pattern corresponding to a first embodiment of a driving method.

FIG. 8 illustrates a light-emitting pattern of a display device according to the first embodiment. As illustrated in FIG. 8, the display device according to the first embodiment may perform an initialization operation, a threshold voltage compensation operation, a data writing operation, and a light-emitting operation (or, a non-light-emitting operation) of a pixel in a line-sequential manner. Therefore, the display device according to the first embodiment may use a progressive driving manner.

With the above description, pixel circuit 1 according to the first embodiment and a display device including the pixel circuit 1 may perform a pre-data writing operation at first and second periods TMA and TMB. Then, a gradation data writing operation may be performed at third and fourth periods TMC and TMD. The display device according to a first embodiment may therefore exhibit improved compensation performance, by deciding an initialization voltage according to a variation in a threshold voltage of a driving transistor M1 or a variation in gradation data and by making a voltage difference between the initialization voltage and the gradation data constant.

In the display device according to the first embodiment, the pre-data writing operation using the first and second periods TMA and TMB may be performed together with a data writing operation on pixel circuits disposed above current pixel circuits. Therefore, since a period needed to perform a data writing operation on current pixel circuits may be formed of the third and fourth periods TMC and TMD, a data writing time may be decided without considering a time taken to perform the pre-data writing operation.

That is, in the display device according to the first embodiment, although a data writing time is shortened by an increase in the number of pixels, a data writing operation may be completed within a time based on an increase in the number of pixels. Since an organic EL element D1 of the display device according to the first embodiment is formed of four transistors and a holding capacitor, for example, the first embodiment of the pixel circuit may be smaller in size, for example, than that shown in FIG. 19.

The display device according to the first embodiment may utilize a bias voltage VBAS and a set voltage VSET, which have different voltage values from each other, as an initialization voltage VCST. The display device according to the first embodiment may be configured to switch a voltage value of the initialization voltage VCST by generating an initialization voltage using a small-sized constant voltage source circuit and selecting one of two voltages through the initialization voltage control circuit 11 and the initialization voltage selecting circuit 12. Thus, in the display device according to the first embodiment, it is possible to reduce the size of circuit associated with operations of generating and switching the initialization voltage VCST.

Also, in the display device according to the first embodiment, a power supply line may be divided into a first power supply line DTa and a second power supply line DTb. The gradation data control circuit 14 may provide a power supply voltage ELVDD and gradation data VDATA to two power supply lines alternately. Thus, the display device according to the first embodiment may not need a transistor that selectively provides the power supply voltage ELVDD and the gradation data VDATA to the source of the driving transistor M1. That is, it is possible to reduce the size of pixel circuit 1 through the gradation data control circuit 14.

Also, a progressive driving manner may be applied to the display device according to the first embodiment. This progressive driving manner is different from a simultaneous driving manner, for example, as explained below.

Figure 9:
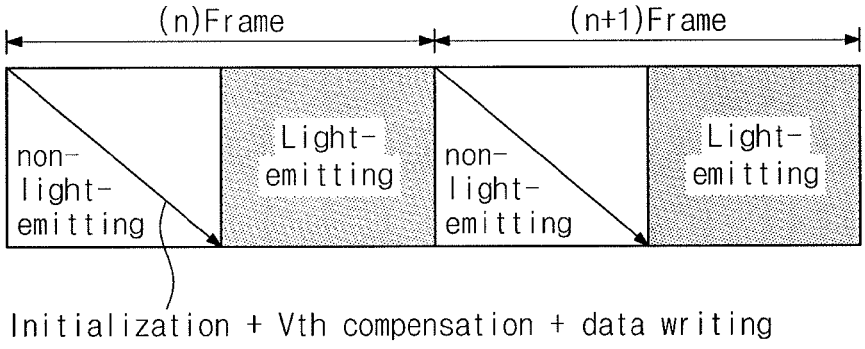
FIG. 9 illustrates a light-emitting pattern based on a simultaneous driving scheme.

FIG. 9 illustrates an example of a light-emitting pattern according to the simultaneous driving manner. As illustrated in FIG. 9, in the simultaneous driving manner, half of one frame period may have a non-light-emitting state and a data update operation need not be performed during a period corresponding to the non-light-emitting state. Meanwhile, in the progressive driving manner, a data update operation may be performed at a light-emitting state. Therefore, a time for a data update period according to the progressive driving manner may be longer than that according to the simultaneous driving manner shown in FIG. 9. As a result, accuracy of threshold voltage compensation is improved. Also, in case of the progressive driving manner, low-frequency driving and free-flicker may be possible, so that the quality of display is improved and power consumption is reduced.

Second Embodiment

Figure 10:
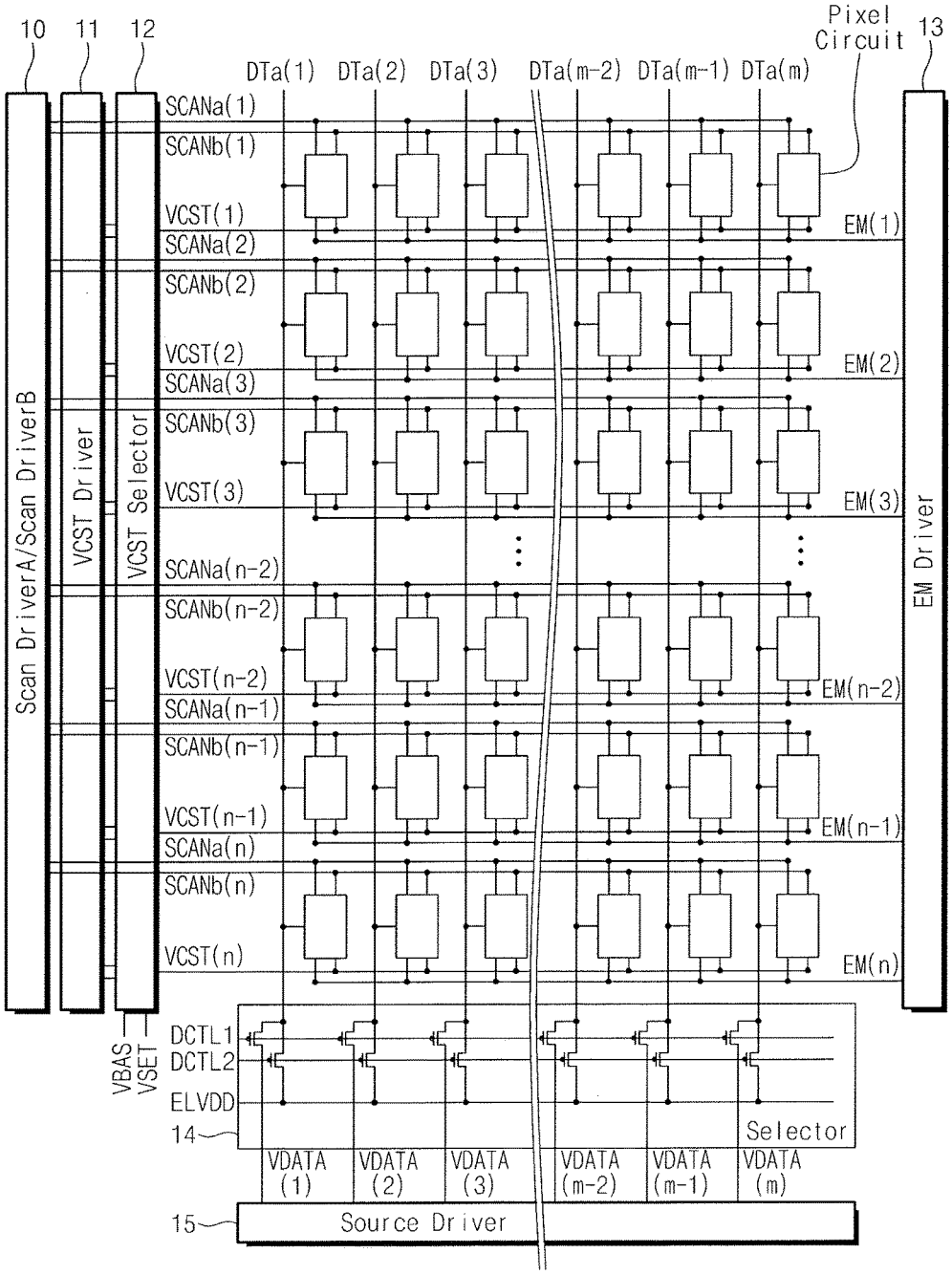
FIG. 10 illustrates a second embodiment of a display device.

FIG. 10 illustrates a second embodiment of a display device which performs simultaneous driving using pixel circuit 1 according to the first embodiment. As illustrated in FIG. 10, a display device according to the second embodiment may be configured such that pixel circuits disposed in the same column are connected to a power supply line DTa. A gradation data control circuit 14 of the display device may provide a power supply voltage ELVDD and gradation data VDATA to the power supply line DTa alternately.

Also, in this embodiment, a method of providing a scan line signal and an initialization voltage VCST when a data update operation for pixel circuit 1 is performed is substantially the same as that according to the first embodiment.

Figure 11:
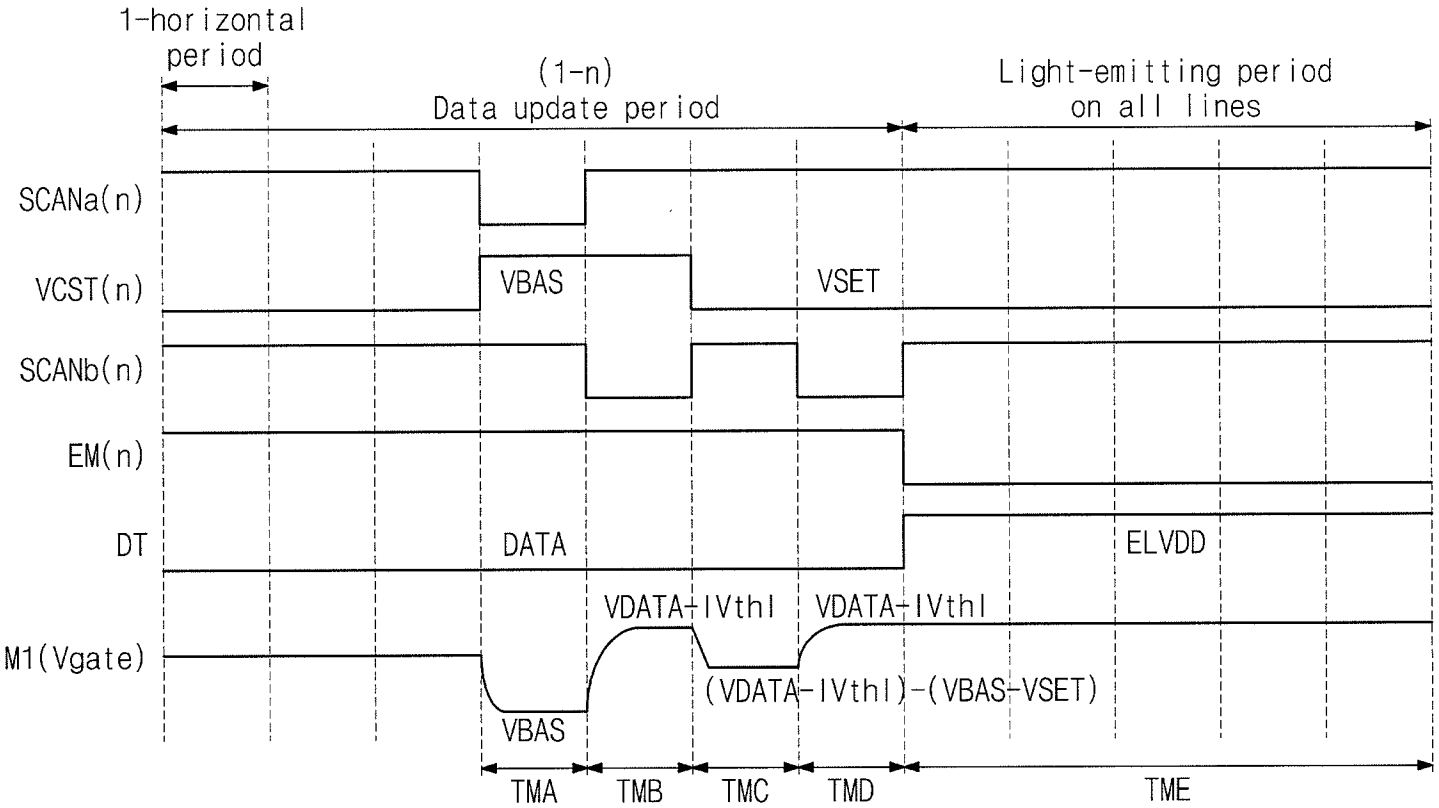
FIG. 11 illustrates a timing diagram showing a driving order of pixel circuits according to the second embodiment.

FIG. 11 illustrates a timing diagram for operating a pixel circuit of the display device according to the second embodiment. As illustrated in FIG. 11, a method of providing an emission control signal EM, gradation data VDATA, and a power supply voltage ELVDD according to the second embodiment is different from the first embodiment. More particularly, during a data update period of the display device according to the second embodiment, an emission transistor M4 may be turned off by an emission control signal EM having a high level. As a result, a current flowing into an organic EL element D1 is blocked.

Also, according to the second embodiment, gradation data may be supplied to a source of driving transistor M1 during the data update period. During the data update period, an organic EL element D1 may emit a light by providing a power supply voltage ELVDD to a source of driving transistor M1 with the emission transistor M4 turned on.

Figure 12:
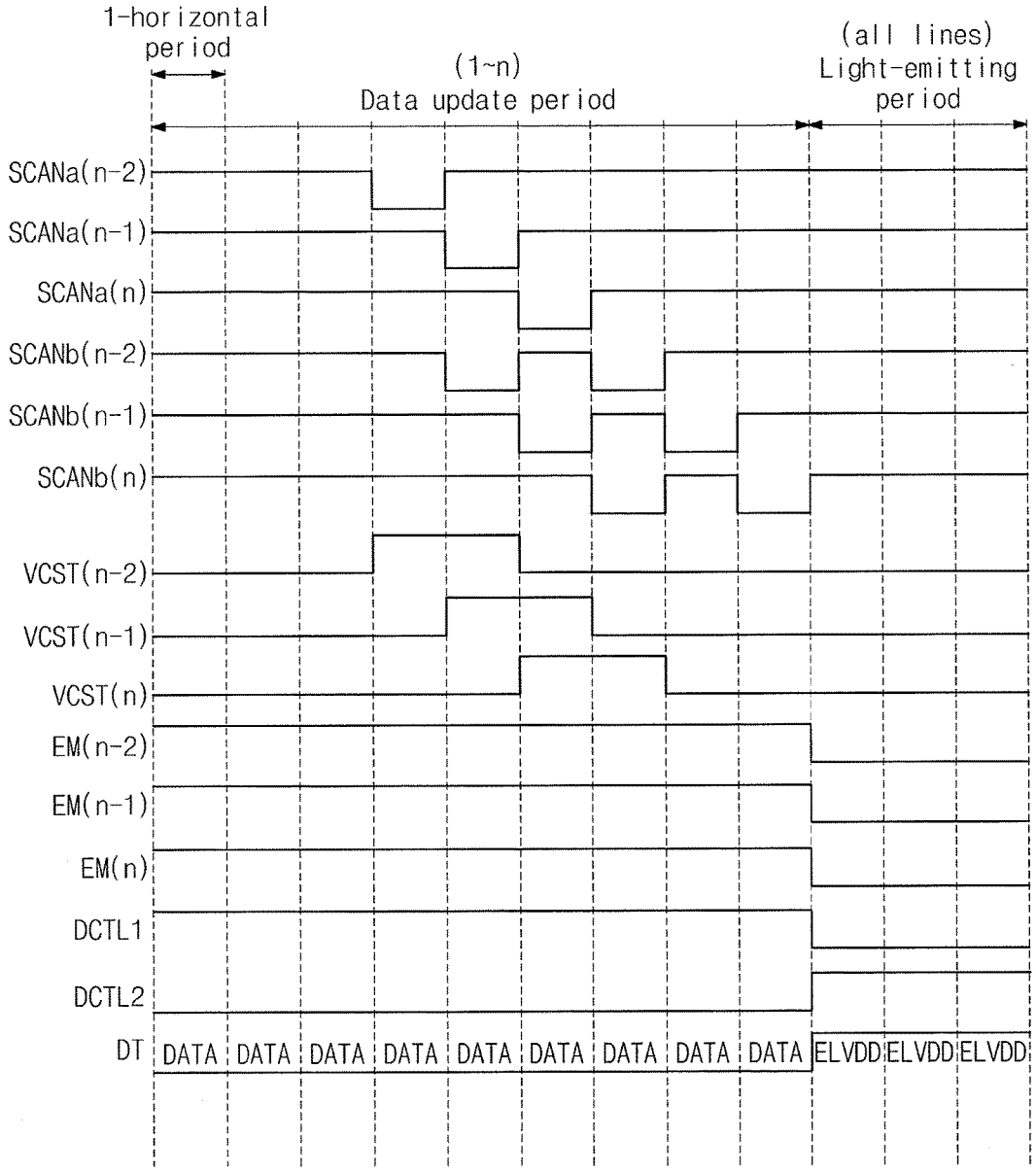
FIG. 12 illustrates operation of the second embodiment of the display device.

FIG. 12 is another timing diagram for operating the display device of the second embodiment. In this embodiment, the display device is driven by a 1-frame period. The 1-frame period may be divided into the first half and the second half. As illustrated in FIG. 12, a data update operation (including an initialization operation, a threshold voltage compensation operation, and a data writing operation) on all pixels may be completed in the first half of a 1-frame period, and all pixels emit light during the second half of the 1-frame period.

More specifically, during the first half, an initialization operation, a threshold voltage compensation operation, and a data writing operation on each pixel circuit is performed in a line-sequential manner. Also, during the first half, all organic EL elements D1 may be in a non-light-emitting state (e.g., corresponding to a black display). During the second half, all pixels may be turned off. In the event that this driving method is used, as illustrated in FIG. 10, the number of lines for transferring gradation data may be 1.

Figure 13:
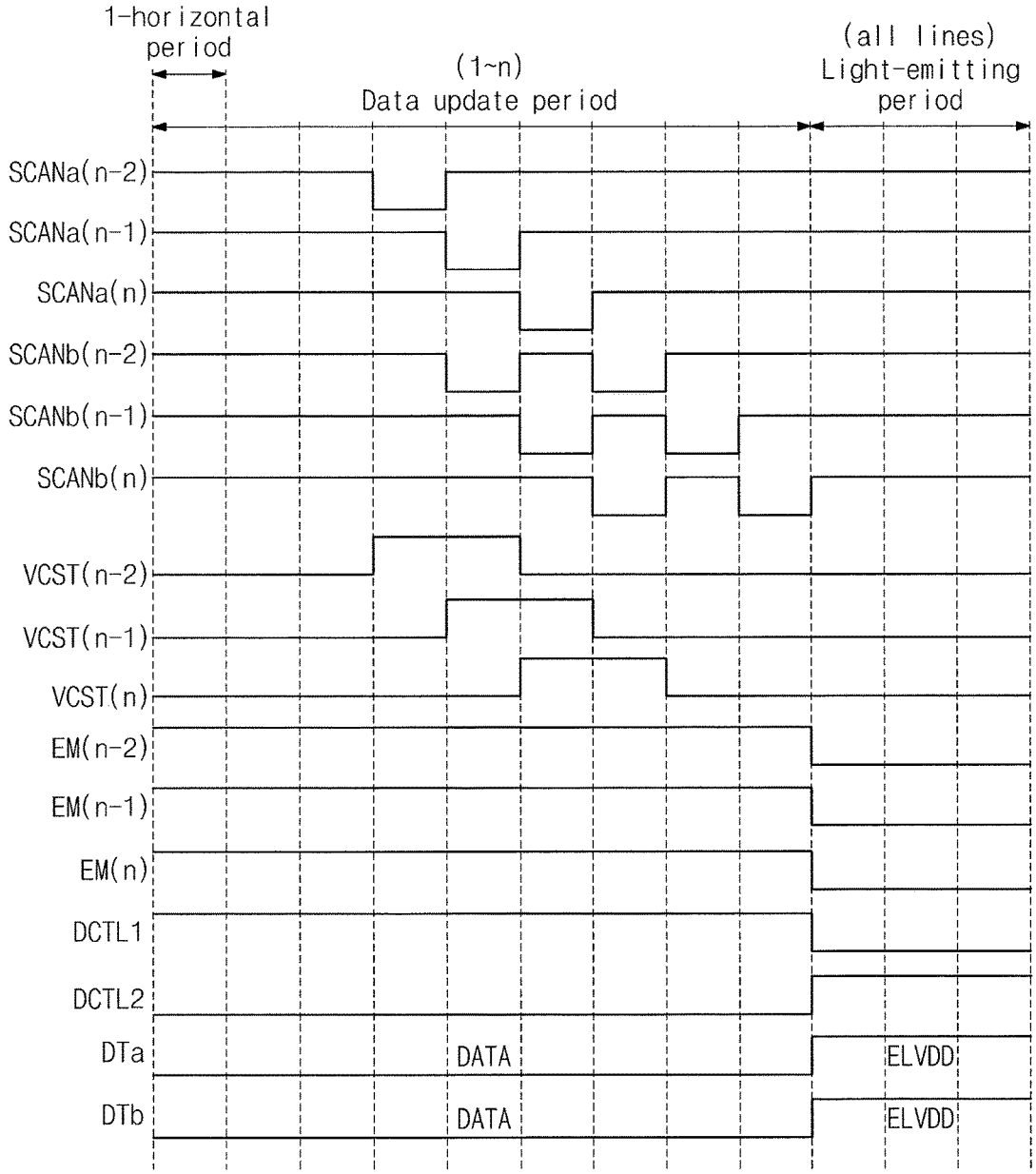
FIG. 13 illustrates operation of the first embodiment of the display device during simultaneous driving.

Although a display device may be configured as illustrated in FIG. 5, that is, although the number of data lines is 2, it is possible to perform simultaneous driving. In this case, as illustrated in FIG. 13, power control signals DCTL1 and DCTL2 may be controlled not to be switched every 1-frame period, but for their logical levels to be switched between a data update period and a light-emitting period.

When the driving method according to the second embodiment is used, a light-emitting period and a non-light-emitting period (including an initialization, threshold voltage compensation, and data writing) of an organic EL element D1 may be divided in a time-division manner. Therefore, if an image is displayed in a three-dimensional manner, it is possible to insert a black display period between left-eye data and right-eye data easily and to display a 3D image where influence of crosstalk is less.

Also, both progressive driving and simultaneous driving may be performed by a display device according to a first embodiment as shown in FIG. 5. For example, switching between 2D display and 3D display may be easily performed by performing progressive driving. The progressive driving may be performed through operation of the display device according to a first embodiment for 2D display. Simultaneous driving may be performed as shown in FIG. 13 for 3D display.

Additionally, the display device according to the second embodiment may have the same pixel circuit as that of a display device according to a first embodiment, and may perform a data update operation of the pixel circuit through the operation described with reference to the first embodiment. Like the display device according to the first embodiment, the display device according to the second embodiment may determine an initialization voltage in connection with gradation data and a threshold voltage of a driving transistor. That is, the second embodiment is advantageous because it can achieve improved compensation performance. Also, since the pixel circuit 1 is formed of four transistors and a capacitor, pixel circuit 1 may be more advantageous for high definition of a panel.

Third Embodiment

Figure 14:
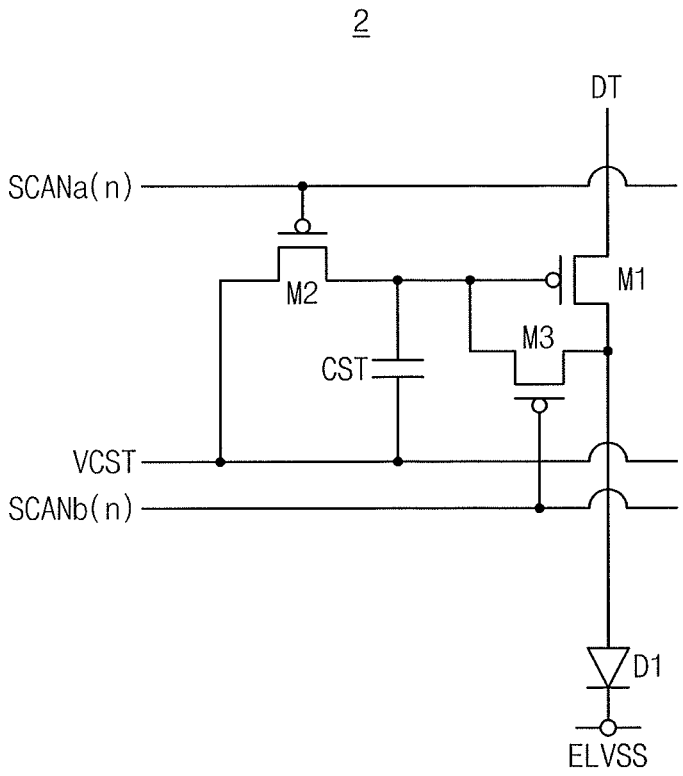
FIG. 14 illustrates the first embodiment of the pixel circuit.

FIG. 14 illustrates a third embodiment of a pixel circuit 2. As illustrated in FIG. 14, a pixel circuit 2 may not include an emission transistor M4 of pixel circuit 1 according to a first embodiment.

Figure 15:
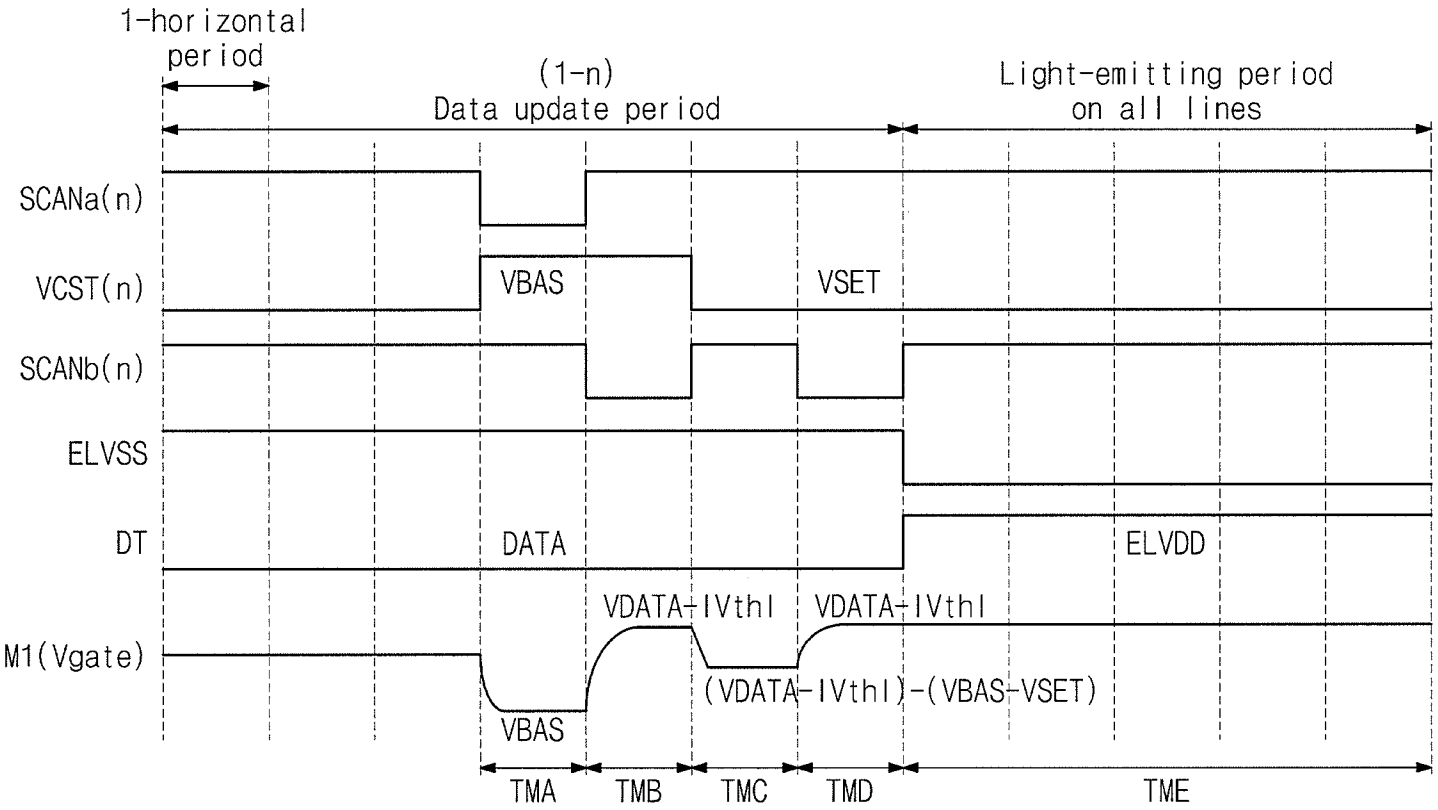
FIG. 15 illustrates a driving order of pixel circuits of a third embodiment.

FIG. 15 is a timing diagram describing operation of pixel circuit 2. As illustrated in FIG. 15, the manner in which first scan line signal SCANa, second scan line signal SCANb, and initialization voltage VCST are applied may be the same as the first embodiment. However, the timing of when a ground voltage ELVSS, gradation data VDATA, and a power supply voltage ELVDD are applied may be different from the first embodiment. Also, a third embodiment of a display device which includes pixel circuit 2 may include a ground voltage control circuit that controls a ground voltage ELVSS, instead of an emission control circuit 13 of a display device according to a second embodiment as shown in FIG. 10.

In pixel circuit 2, during a data update period, a current flowing into an organic EL element D1 may be blocked because a ground voltage ELVSS has a high level. Also, gradation data VDATA may be supplied to the source of driving transistor M1 in the data update period. As a result, pixel circuit 2 may perform a data update operation without light-emitting during the data update period.

Figure 16A:
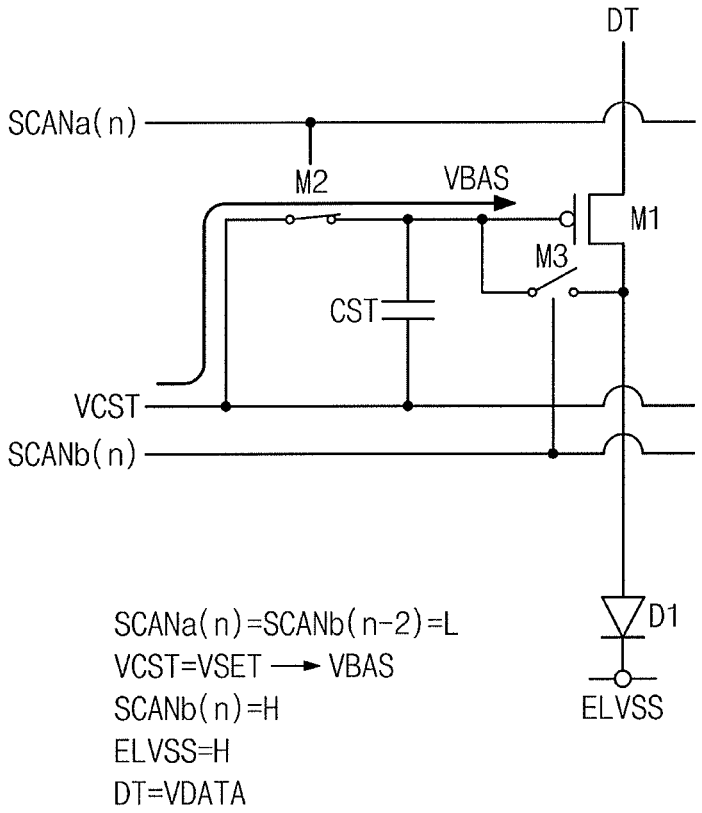
FIG. 16A illustrates operation of the pixel circuit of the third embodiment during a first period.

FIGS. 16A-16D illustrate the states of pixel circuit 2 in four periods. As illustrated in FIG. 16A, since a ground voltage ELVSS has a high level at the first period TMA, no current may flow into an organic EL element D1, a bias voltage VBAS may be applied to a gate of a driving transistor M1, and charges of a holding capacitor CST may be reset.

Figure 16B:
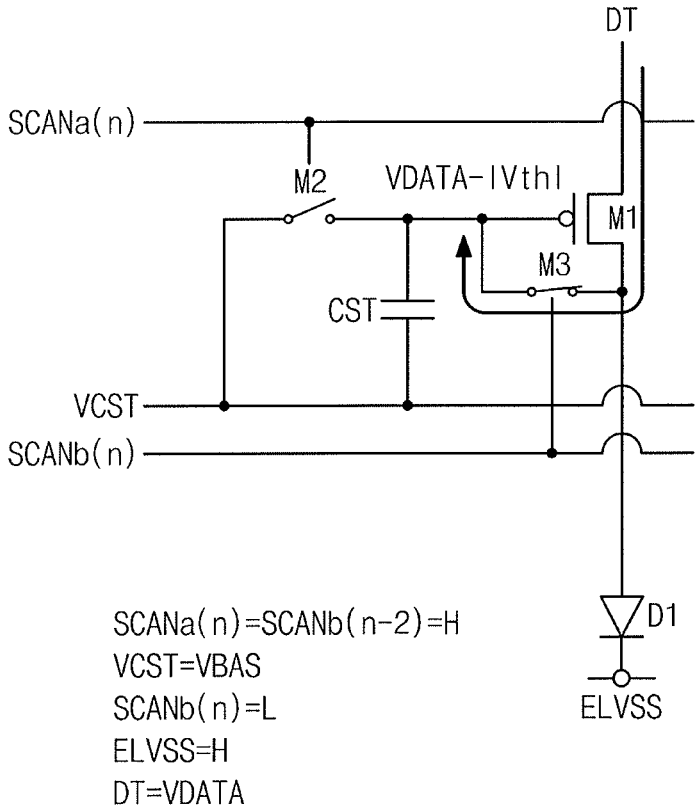
FIG. 16B illustrates operation of the pixel circuit in a second period.

As illustrated in FIG. 16B, since the ground voltage ELVSS has a high level at the second period TMB, no current may flow into an organic EL element D1. During the second period TMB, a first gradation voltage according to gradation data VDATA may be written at a gate of a driving transistor M1 through the driving transistor M1 and a second switch transistor M3.

Figure 16C:
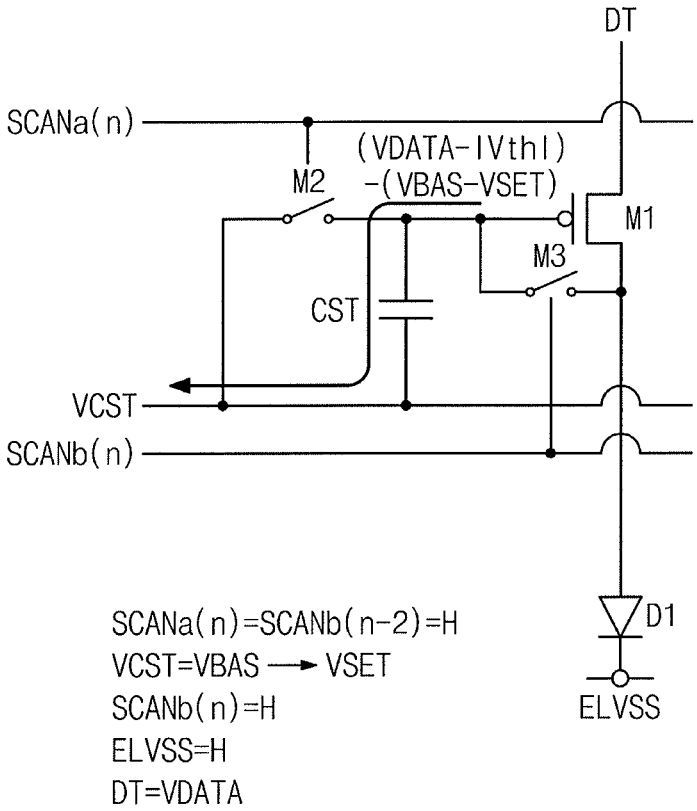
FIG. 16C illustrates operation of the pixel circuit in a third period.

As illustrated in FIG. 16C, since the ground voltage ELVSS has a high level at the second period TMB, no current may flow into an organic EL element D1. During the third period TMC, an initialization voltage VCST may be switched from a bias voltage VBAS to a set voltage VSET, and a gate voltage Vgate of a driving transistor M1 may vary according to a variation in an initialization voltage VCST.

Figure 16D:
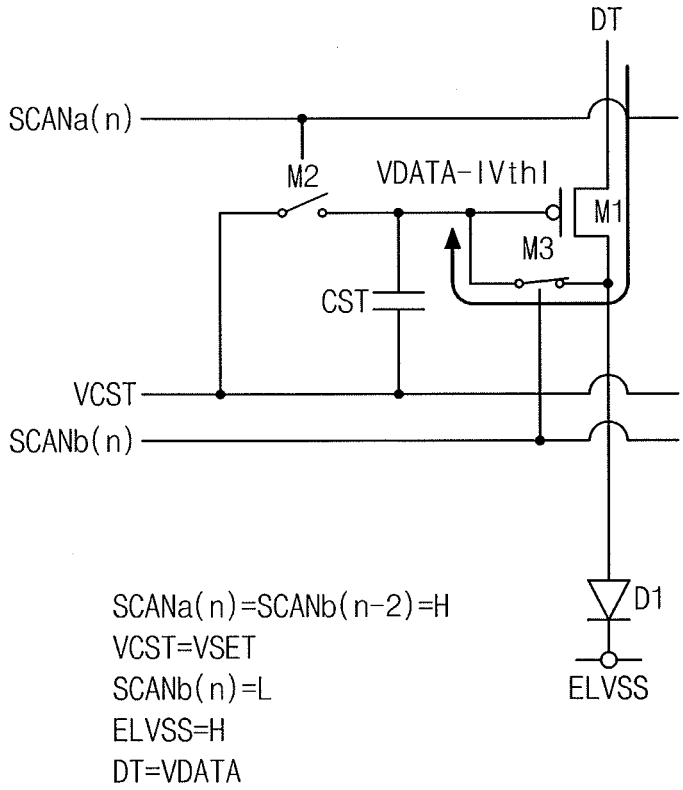
FIG. 16D illustrates operation of the pixel circuit in a fourth period.

As illustrated in FIG. 16D, since the ground voltage ELVSS has a high level at the second period TMB, no current may flow into an organic EL element D1. During the fourth period TMD, a second gradation voltage according to gradation data VDATA may be written at a gate of a driving transistor M1 through the driving transistor M1 and a second switch transistor M3. At the fourth period TMD, the second gradation voltage may be written using a gate voltage of the driving transistor M1 as an initialization voltage at a point of time when the third period TMC is completed.

In pixel circuit 2, since the ground voltage ELVSS has a low level at a light-emitting period, a current may flow into an organic EL element D1. Also, a power supply voltage ELVDD may be applied to a source of a driving transistor M1 during the light-emitting period.

Figure 16E:
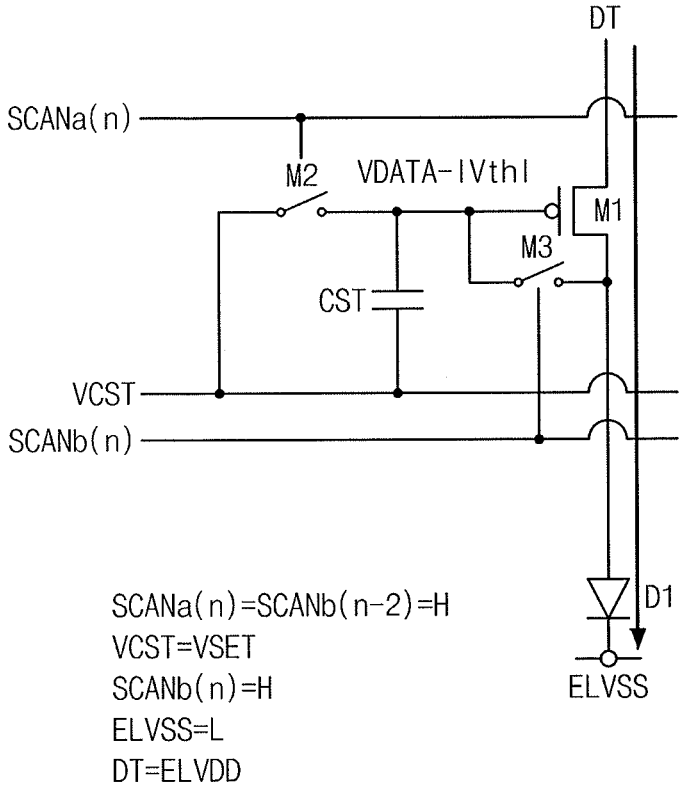
FIG. 16E illustrates operation of a pixel circuit in a fifth period.

As illustrated in FIG. 16E, since a ground voltage ELVSS has a low level during the fifth period TME, a current may flow into an organic EL element D1 through a driving transistor M1.

Also, for pixel circuit 2, a method of providing gradation data VDATA and a power supply voltage ELVDD may be the same as the second embodiment. Also, operation of pixel circuit 2 may be implemented the same manner as the display device according to a second embodiment by controlling a voltage level of a ground voltage ELVSS instead of an emission control signal EM.

Figure 17:
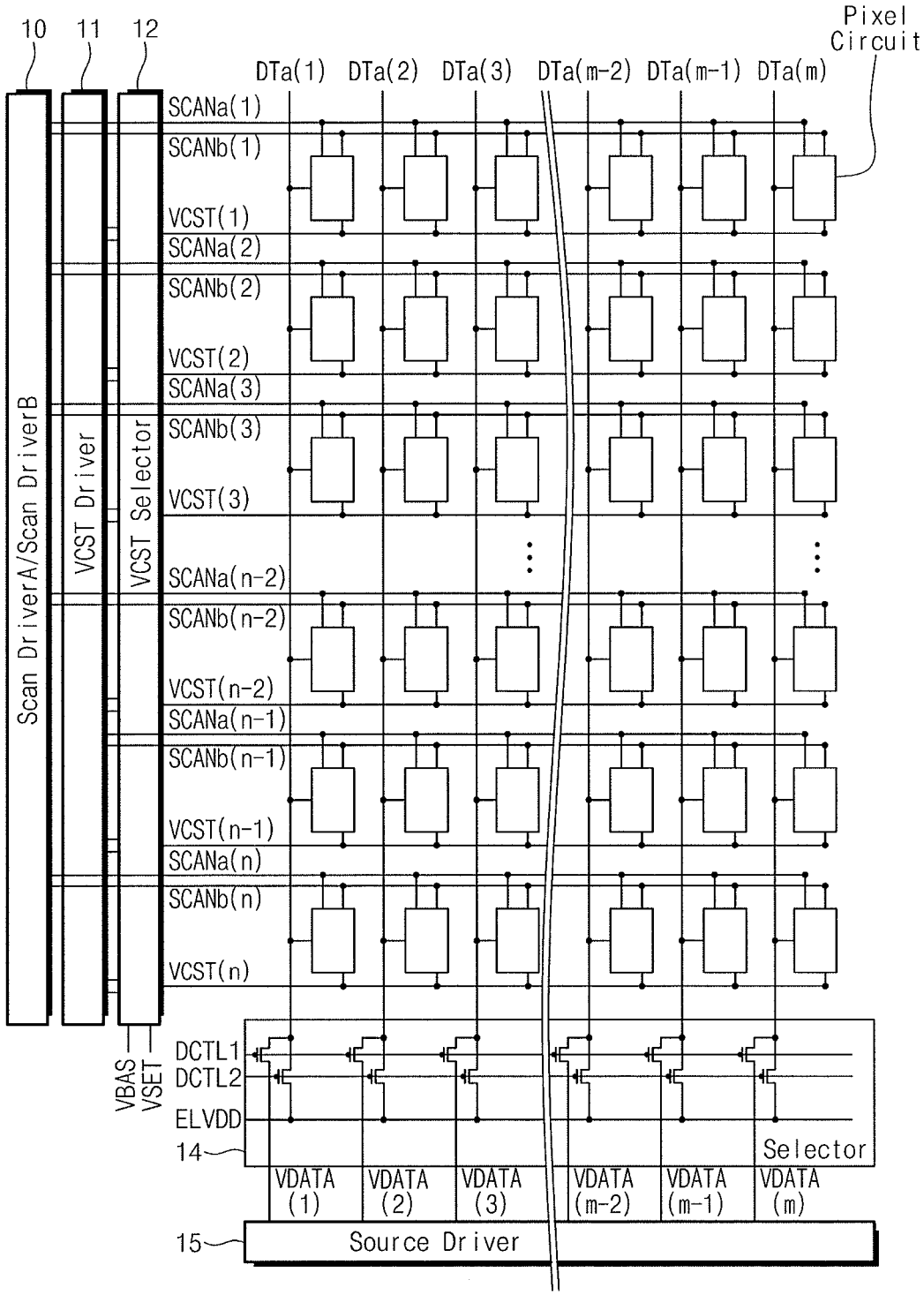
FIG. 17 illustrates a display device with a pixel circuit of the third embodiment.

FIG. 17 illustrates a display device including a driving circuit according to a third embodiment. As illustrated in FIG. 17, the driving circuit according to a third embodiment may not include an emission control circuit 13 of the second embodiment shown in FIG. 10.

Figure 18:
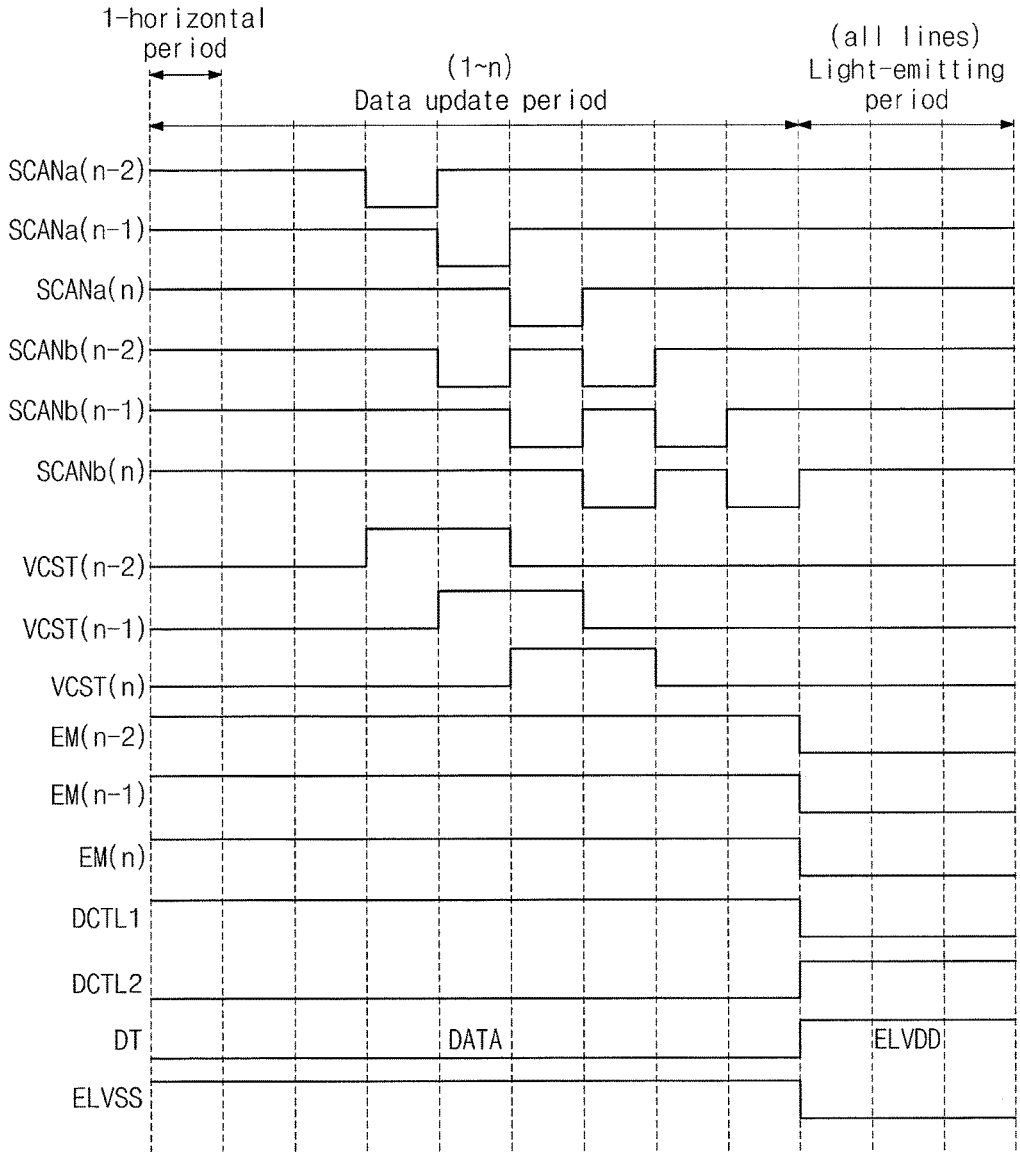
FIG. 18 illustrates operation of the display device of the third embodiment.

FIG. 18 illustrates a timing diagram for operating a display device including the driving circuit of the third embodiment. This display device may be configured such that a ground voltage ELVSS is controlled to have the same logical level as an emission control signal of the display device according to a second embodiment. As a result, operation of the display device according to the third embodiment may be performed in the same manner as the second embodiment.

Since the pixel circuit 2 according to the third embodiment does not include an emission transistor M4, its size may be smaller than that of a pixel circuit 1 according to a first embodiment. A control method of pixel circuit 2 may be the same as the second embodiment. A display device including pixel circuit 2 according to the third embodiment may perform simultaneous driving like a display device according to the second embodiment.

Also, pixel circuit 2 according to the third embodiment may write gradation data in the same order as a pixel circuit 1 according to the first embodiment. Therefore, a display device including pixel circuit 2 may determine an initialization voltage in connection with a threshold voltage of a driving transistor M1 and gradation data like a display device according to the first embodiment. As a result, the display device according to the third embodiment may realize improved compensation performance.

The pixel circuits according to the embodiments described herein are shown to use PMOS transistors. However, in other embodiments NMOS transistors, or a combination of NMOS and PMOS transistors, may be used to form the pixel circuits.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device comprising:

at least one pixel circuit including:

a light-emitting element, a holding capacitor to hold a gradation voltage corresponding to gradation data, a driving transistor to provide the light-emitting element with a driving current according to the gradation voltage, a first switch transistor connected between an initialization voltage line for transferring an initialization voltage and a gate of the driving transistor, the first switch transistor to be turned on or off according to a first scan line signal, and a second switch transistor connected between the gate and a drain of the driving transistor, the second switch transistor to be turned on or off according to a second scan line signal; and a control circuit to output the first scan line signal, the second scan line signal, and the initialization voltage, wherein:

during a first period, the control circuit turns on the first switch transistor and turns off the second switch transistor to set charges of the holding capacitor to an initial state using a first initialization voltage having a first voltage level as the initialization voltage;

during a second period, the control circuit turns off the first switch transistor and turns on the second switch transistor to charge the holding capacitor based on a first gradation voltage corresponding to first gradation data using the first initialization voltage as the initialization voltage;

during a third period, the control circuit turns off the first switch transistor and the second switch transistor to switch the initialization voltage from the first initialization voltage to a second initialization voltage having a second voltage level different from the first voltage level;

during a fourth period, the control circuit turns off the first switch transistor and turns on the second switch transistor to charge the holding capacitor based on a second gradation voltage based on the second initialization voltage, the second gradation voltage corresponding to second gradation data;

during a fifth period, the control circuit drives the light-emitting element according to the second gradation voltage when the driving transistor is turned on.

2. The display device as claimed in claim 1, wherein the driving transistor, the first switch transistor, and the second switch transistor are P-type transistors.

3. The display device as claimed in claim 2, wherein the pixel circuit comprises an emission transistor connected between the drain of the driving transistor and the light-emitting element, wherein the control circuit turns off the emission transistor during the first to fourth periods.

4. The display device as claimed in claim 2, wherein the pixel circuit comprises an emission transistor connected between the drain of the driving transistor and the light-emitting element, wherein the control circuit turns on the emission transistor during the fifth period.

5. The display device as claimed in claim 1, further comprising:

a power line control circuit to provide a power supply voltage to a source of the driving transistor during the first period and the third period and to provide the gradation data to the source of the driving transistor during the second period and the fourth period.

6. The display device as claimed in claim 5, further comprising:

a plurality of pixel circuits arranged in a lattice, a first power supply line connected to pixel circuits disposed at an odd-numbered row; and a second power supply line connected to pixel circuits disposed at an even-numbered row, wherein the power line control circuit provides the gradation data to the second power supply line during a period where the power supply voltage is applied to the first power supply line and provides the power supply voltage to the second power supply line during a period where the gradation data is applied to the first power supply line.

7. The display device as claimed in claim 1, further comprising:

a power line control circuit to provide gradation data to a source of the driving transistor during the first to fourth periods and a power supply voltage to the source of the driving transistor during the fifth period.

8. The display device as claimed in claim 7, further comprising:

a voltage control circuit to provide a high level of voltage to a cathode of the light-emitting element during the first to fourth periods and a low level of voltage to the cathode of the light-emitting element during the fifth period.

9. The display device as claimed in claim 1, wherein the first initialization voltage is higher than the second initialization voltage.

10. A method of driving a pixel circuit which includes a light-emitting element, a holding capacitor to hold a gradation voltage corresponding to a gradation data, a driving transistor to provide the light-emitting element with a driving current according to the gradation voltage, a first switch transistor connected between an initialization voltage line for transferring an initialization voltage and a gate of the driving transistor and to be turned on or off according to a first scan line signal, and a second switch transistor connected between the gate and a drain of the driving transistor and to be turned on or off according to a second scan line signal, the method comprising:

during a first period, turning on the first switch transistor and turning off the second switch transistor to set charges of the holding capacitor to an initial state using a first initialization voltage having a first voltage level as the initialization voltage;

during a second period, turning off the first switch transistor and turning on the second switch transistor to charge the holding capacitor based on a first gradation voltage corresponding to first pixel data using the first initialization voltage as the initialization voltage;

during a third period, turning off the first switch transistor and the second switch transistor to switch the initialization voltage from the first initialization voltage to a second initialization voltage having a second voltage level different from the first voltage level;

during a fourth period, turning off the first switch transistor and turning on the second switch transistor to charge the holding capacitor based on a second gradation voltage corresponding to second pixel data using the second initialization voltage as the initialization voltage; and during a fifth period, driving the light-emitting element according to the second gradation voltage when the driving transistor is turned on.

11. The method as claimed in claim 10, wherein the driving transistor, the first switch transistor, and the second switch transistor are P-type transistors.

12. The method as claimed in claim 11, wherein the pixel circuit comprises an emission transistor connected between the drain of the driving transistor and the light-emitting element, and wherein the method further comprises turning off the emission transistor during the first to fourth periods.

13. The method as claimed in claim 11, wherein the pixel circuit comprises an emission transistor connected between the drain of the driving transistor and the light-emitting element, and wherein the method further comprises turning on the emission transistor during the fifth period.

14. The method as claimed in claim 10, further comprising:

providing a power supply voltage to a source of the driving transistor during the first period and the third period, and providing the gradation data to the source of the driving transistor during the second period and the fourth period.

15. The method as claimed in claim 14, wherein the pixel circuit is disposed in plurality to have a lattice shape, wherein a first power supply line is connected to pixel circuits disposed at an odd-numbered row and a second power supply line is connected to pixel circuits disposed at an even-numbered row, and wherein the gradation data is provided to the second power supply line during a period where the power supply voltage is applied to the first power supply line and the power supply voltage is provided to the second power supply line during a period where the gradation data is applied to the first power supply line.

16. The method as claimed in claim 10, wherein gradation data is provided to a source of the driving transistor during the first to fourth periods and a power supply voltage is provided to the source of the driving transistor during the fifth period.

17. The method as claimed in claim 16, wherein a high level of ground voltage is provided to a cathode of the light-emitting element during the first to fourth periods and a low level of ground voltage is provided to the cathode of the light-emitting element during the fifth period.

18. The method as claimed in claim 10, wherein the first initialization voltage is higher than the second initialization voltage.

* * * * *